US008115143B2

(12) United States Patent
Hayashi et al.

(10) Patent No.: US 8,115,143 B2
(45) Date of Patent: Feb. 14, 2012

(54) THERMAL ROLL, AND DRYING APPARATUS AND METHOD

(75) Inventors: Kenji Hayashi, Shizuoka (JP); Toru Onogawa, Shizuoka (JP)

(73) Assignee: Fujifilm Corporation, Tokyo (JP)

( * ) Notice: Subject to any disclaimer, the term of this patent is extended or adjusted under 35 U.S.C. 154(b) by 401 days.

(21) Appl. No.: 12/385,877

(22) Filed: Apr. 22, 2009

(65) Prior Publication Data

US 2009/0272005 A1 Nov. 5, 2009

Related U.S. Application Data

(62) Division of application No. 10/743,031, filed on Dec. 23, 2003, now Pat. No. 7,541,560.

(30) Foreign Application Priority Data

Dec. 25, 2002 (JP) ..... 2002-373886
Jan. 27, 2003 (JP) ..... 2003-017366
Feb. 20, 2003 (JP) ..... 2003-042976

(51) Int. Cl.
*B21B 27/06* (2006.01)
*B30B 3/00* (2006.01)

(52) U.S. Cl. ..... 219/469; 100/153

(58) Field of Classification Search ..... 219/469, 219/552; 100/153

See application file for complete search history.

(56) References Cited

U.S. PATENT DOCUMENTS 2,146,281 A 2/1939 Anderson
3,260,642 A 7/1966 Canter, Jr.
4,365,423 A 12/1982 Arter et al.
4,628,183 A 12/1986 Satomura
4,804,823 A 2/1989 Okuda et al.
5,187,849 A 2/1993 Kobayashi
5,674,621 A 10/1997 Visser et al.
6,065,396 A 5/2000 Schiel et al.
6,256,903 B1 7/2001 Rudd
6,428,851 B1 8/2002 Friedersdorf et al.
2004/0141779 A1 7/2004 Yanagida et al.

FOREIGN PATENT DOCUMENTS

JP 09-066259 3/1997
JP 10-293488 11/1998
JP 2000039729 2/2000

*Primary Examiner* — Daniel L Robinson
(74) *Attorney, Agent, or Firm* — McQinn Intellectual Property Law Group, PLLC

(57) ABSTRACT

A drying apparatus includes a thermal roll for contacting and heating aluminum web in a continuous sheet form. The thermal roll includes a roll surface, having a static friction coefficient μ defined by contact with the web. The static friction coefficient μ satisfies a condition of:

$$t+V \leqq G$$

wherein $$G = \mu \cdot \sigma_{A1} = \mu \cdot t \cdot \sin(\theta/2)$$

where t is tension applied to the web;
G is roll retaining force with which the roll surface frictionally retains the web;
V is thermal expansion force generated by thermal expansion of the web retained on the roll surface;
$\sigma_{A1}$ is pressing force caused by the tension to the web and applied to the roll surface by the web;
θ is a wrap angle at which the web contacts the roll surface.
Thus, distortion of the web can be prevented even with a great difference in the temperature from the thermal roll.

27 Claims, 14 Drawing Sheets

THERMAL ROLL, AND DRYING APPARATUS AND METHOD

The present application is a Divisional Application of U.S. patent application Ser. No. 10/743,031 which was filed on Dec. 23, 2003 now U.S. Pat. No. 7,541,560.

BACKGROUND OF THE INVENTION

1. Field of the Invention

The present invention relates to a thermal roll, and a drying apparatus and method. More particularly, the present invention relates to a thermal roll, and a drying apparatus and method, in which distortion of web to be heated or dried can be prevented even when a great difference lies in the temperature between the web and the thermal roll.

2. Description Related to the Prior Art

A presensitized (PS) plate is produced by use of aluminum web in a continuous shape. On the aluminum web, at least one first surface is finished according to graining. The first surface is coated with liquid material that is printing plate producing layer forming solution, and includes photosensitive resin or thermosensitive resin.

In order to heat and dry the aluminum web coated with the printing plate producing layer forming solution, drying with fluid medium, such as hot gas, is generally used.

However, the drying with gas has serious problems in that a manufacturing system requires an excessively large size, because of very low heat transfer efficiency for transfer of heat to the aluminum web. Load in the drying is considerably high if the printing plate producing layer forming solution requires drying in a drying process for the aluminum web after being coated.

Various methods are known in the prior art to prevent excessive enlargement of the manufacturing system in view of the drying operation. For example, nozzles for blowing the hot gas at a high flow rate are used. Also, two paths for the hot gas are disposed for blowing two sides of the aluminum web with the hot gas.

However, the above-mentioned methods cannot be used in an initial step of the drying, because blowing the coated surface being still wet at a high flow rate of the hot gas is inappropriate, and causes nonuniformity in the condition of the coated surface. Should the flow rate of the hot gas be set remarkably higher, the heat transfer efficiency cannot be increased. The coated surface cannot be dried effectively.

It is possible to raise the heat transfer efficiency if thermal rolls are used according to a heating method of heat transfer. However, problems arise in occurrence of wrinkles, scratches, folds or other damages. The use of the thermal rolls has been effective only in a later half of the drying process in order to raise the temperature of the aluminum web by several degrees centigrade (° C.).

JP-A 9-066259, specifically pages 2 and 3 and FIG. 1, discloses an additional drying device. Also, there is conception of structurally simplifying the manufacturing system. However, it is difficult or impossible instantaneously to change the temperature of the hot gas. A change in the temperature condition of the aluminum web requires much time. This is a serious problem specially if a characteristic of the aluminum web, for example a width, thickness, web substance or the like, is altered within the uninterrupted web traveling through the manufacturing system for industrial requirement or for any reason. It is conceivable to stop or slow down the aluminum web in a temporary manner. However, such conceptions will cause waste of time in this step included in all the process of the manufacture.

SUMMARY OF THE INVENTION

In view of the foregoing problems, an object of the present invention is to provide a thermal roll, and a drying apparatus and method, in which distortion of continuous material to be heated or dried can be prevented even when a great difference lies in the temperature between the continuous material and a thermal roll.

Another object of the present invention is to provide a thermal roll, and a drying apparatus and method, in which temperature of continuous material can be set at target temperature even when a change occurs in a characteristic of the continuous material web traveling through a manufacturing system.

In order to achieve the above and other objects and advantages of this invention, a thermal roll for contacting and heating continuous material in a sheet, film or plate form is provided. The thermal roll includes a roll surface, having a static friction coefficient μ defined by contact with the continuous material, wherein the static friction coefficient μ satisfies a condition of:

$$t+V \leqq G$$

wherein $$G = \mu \cdot \sigma_{A1} = \mu \cdot t \cdot \sin(\theta/2)$$

where t is tension applied to the continuous material;

G is roll retaining force with which the thermal roll frictionally retains the continuous material;

V is thermal expansion force generated by thermal expansion of the continuous material retained on the thermal roll;

$\sigma_{A1}$ is pressing force caused by the tension to the continuous material and applied to the roll surface by the continuous material;

θ is a wrap angle at which the continuous material contacts the roll surface.

The continuous material has coating liquid.

A temperature difference between the roll surface and the continuous material before contact therewith is in a range of 50-100° C.

The static friction coefficient μ further satisfies a condition of:

$$\sigma_{A1}+\alpha \cdot E \cdot \Delta T/(1-\nu) \leqq 10/\mu$$

where α is coefficient of linear expansion of the continuous material;

E is modulus of elasticity of the continuous material in a direction of a thickness thereof;

ΔT is a temperature difference between the roll surface and the continuous material before contact therewith;

ν is Poisson ratio of the continuous material.

The roll surface has a coating of at least a selected one of plating of metal, ceramic material, fluorine resin, high-density polyethylene resin, and elastomer.

The continuous material is constituted by a selected one of aluminum web, stainless steel in a continuous form, a steel plate, an aluminum plate, and a light alloy plate.

Also, a drying apparatus for drying continuous material in a sheet, film or plate form is provided. There is at least one thermal roll for transporting the continuous material, and for heating the continuous material for drying operation, the thermal roll including a roll surface, having a static friction coefficient μ defined by contact with the continuous material, wherein the static friction coefficient μsatisfies a condition of:

$$t+V \leqq G$$

wherein $$G = \mu \cdot \sigma_{A1} = \mu \cdot t \cdot \sin(\theta/2)$$

where t is tension applied to the continuous material;

G is roll retaining force with which the thermal roll frictionally retains the continuous material;

V is thermal expansion force generated by thermal expansion of the continuous material retained on the thermal roll;

$\sigma_{A1}$ is pressing force caused by the tension to the continuous material and applied to the roll surface by the continuous material;

θ is a wrap angle at which the continuous material contacts the thermal roll.

The thermal roll is disposed under and supports the continuous material. Furthermore, at least one hot gas nozzle device blows hot gas to the continuous material.

Furthermore, at least one drying box contains the thermal roll, the drying box being adapted to transporting the continuous material inside. An exhausting port is formed in a portion of the drying box positioned downwards as viewed in a feeding direction. There is a fan or blower for flow of the hot gas from the hot gas nozzle device to the exhausting port along the continuous material.

The continuous material has a coated surface directed upwards and coated with coating liquid. The hot gas nozzle device is disposed higher than the thermal roll, and opposed thereto, and blows the hot gas to the coated surface.

According to one aspect of the invention, a drying apparatus for drying continuous material in a sheet, film or plate form coated with coating liquid is provided. A temperature adjustor administers the continuous material by setting the continuous material at a target temperature. A controller determines a new target temperature upon occurrence of a change in a characteristic of the continuous material, and controls the temperature adjustor in consideration thereof in place of the target temperature, to stabilize drying of the coating liquid.

Furthermore, a signal generator is responsive to the change in the characteristic of the continuous material, for outputting changing information, to supply the controller therewith.

The continuous material includes a first web section, and a second web section, positioned downstream or upstream from the first web section, and different in the characteristic. A splice portion connects ends of the first and second web sections with one another. The signal generator is constituted by a sensor for detecting the splice portion.

The second web section extends downstream from the first web section. The new target temperature is higher than the target temperature if the second web section has the characteristic of lower rapidity in being dried than the first web section, and is lower than the target temperature if the second web section has the characteristic of higher rapidity in being dried than the first web section.

The characteristic of the continuous material is at least one of a width, thickness, composition and substance thereof.

Furthermore, at least one pass roll transports the continuous material by rotating. The temperature adjustor includes at least one heat adjusting pass roll, positioned upstream or downstream from the pass roll, being rotatable, for contacting a surface of the continuous material. A heat control device controls roll surface temperature of the heat adjusting pass roll.

The heat control device changes heat of the heat adjusting pass roll by a process of using radiant heat, or an induction heating process.

In one preferred embodiment, the heat control device includes a wrap angle adjustor for shifting the heat adjusting pass roll relative to a feeding path of the continuous material, to change a wrap angle where the heat adjusting pass roll contacts the continuous material.

In another preferred embodiment, the heat control device comprises a heat exchange medium circulator, for circulating heat exchange medium at a predetermined temperature through a roll conduit inside the heat adjusting pass roll.

The heat exchange medium circulator further includes at least first and second conduits for supplying respectively at least first and second heat exchange media which are different in temperature from one another. The temperature adjustor further includes a changeable valve mechanism connects the roll conduit with a selected one of the at least first and second conduits, to adjust heat supplied on the continuous material by selective use of the first and second heat exchange media.

The controller controls the valve mechanism sequentially in first, second and third steps, and when in the first step, the valve mechanism selectively enables the first conduit, and a roll surface of the heat adjusting pass roll is set at an initial temperature by circulating the first heat exchange medium. When in the second step, the valve mechanism selectively enables the second conduit, and the second heat exchange medium is provided according to a difference between the initial temperature and the target temperature, to heat or cool the roll surface to the target temperature from the initial temperature. When the roll surface is set at the target temperature, the valve mechanism starts the third step, and selects the first conduit, and the first heat exchange medium keeps the roll surface at the target temperature.

Furthermore, there is a thermometer unit for temperature measurement of the roll surface, to check the initial temperature thereof. The temperature adjustor includes first and second adjusting sections for adjusting temperature of respectively the first and second heat exchange media. When in the first step, the controller causes the first adjusting section to keep the first heat exchange medium at the initial temperature, for setting the roll surface at the initial temperature, and causes the second adjusting section to heat or cool the second heat exchange medium to a switching temperature, wherein a difference between the switching temperature and the initial temperature is greater than a difference between the initial temperature and the target temperature to quicken switching. When in the second step, the controller causes the first adjusting section to heat or cool the first heat exchange medium to the target temperature.

The heat exchange medium circulator includes first and second conduits for circulating respectively the first and second heat exchange media, and each of the first and second conduits is associated with a heat source for setting the first or second heat exchange medium at predetermined temperature, a tank for containing the first or second heat exchange medium, and a valve for openably closing the first or second conduit.

In a further preferred embodiment, the at least first and second heat exchange media are first, second and third heat exchange media, and the at least first and second conduits are first, second and third conduits, and the valve mechanism connects the roll conduit with a selected one of the first, second and third conduits, for supply of an associated one of the first, second and third heat exchange media. The temperature adjustor includes a first adjusting section for keeping the first heat exchange medium at a low target temperature adapted for drying a first web section included in the continuous material. A second adjusting section adjusts temperature of the second heat exchange medium. A third adjusting section keeps the third heat exchange medium at a high target temperature adapted for drying a second web section which is included in the continuous material, and has lower rapidity in being dried than the first web section. The controller controls the valve mechanism cyclically in first, second, third and fourth steps, and when in the first step, the valve mechanism selectively enables the first conduit to keep the roll surface at the low target temperature, the second adjusting section heats the second heat exchange medium to a high switching temperature which is higher than the high target temperature. When in the second step, the valve mechanism selectively enables the second conduit, to heat the roll surface with the second heat exchange medium. When the roll surface is set at the high target temperature, the controller starts the third step, the valve mechanism selectively enables the third conduit, to keep the roll surface at the high target temperature with the third heat exchange medium, the second adjusting section cools the second heat exchange medium to a low switching temperature which is lower than the low target temperature. When in the fourth step, the valve mechanism selectively enables the second conduit, to cool the roll surface with the second heat exchange medium. When the roll surface is set at the low target temperature, the controller starts the first step.

In another preferred embodiment, the at least one heat adjusting pass roll comprises plural heat adjusting pass rolls being different in roll surface temperature from one another. The temperature adjustor further includes a selection mechanism for setting and enabling a selected one of the plural heat adjusting pass rolls in a feeding path of the continuous material, to adjust heat supplied thereon.

The plural heat adjusting pass rolls are first and second heat adjusting pass rolls. The temperature adjustor includes first and second adjusting sections for adjusting temperature of respectively the first and second heat adjusting pass rolls. The controller controls the selection mechanism sequentially in first, second and third steps, and when in the first step, the first adjusting section keeps the first heat adjusting pass roll at an initial temperature, and the selection mechanism enables the first heat adjusting pass roll, to set the continuous material at the initial temperature, and the second adjusting section heats or cools the second heat adjusting pass roll to a switching temperature, wherein a difference between the switching temperature and the initial temperature is greater than a difference between the initial temperature and the target temperature to quicken switching. When in the second step, the selection mechanism enables the second heat adjusting pass roll, to heat or cool the continuous material to the target temperature from the initial temperature, the first adjusting section sets the first heat adjusting pass roll at the target temperature. When the continuous material is set at the target temperature, the selection mechanism starts the third step, and enables the first heat adjusting pass roll, to keep the continuous material at the target temperature.

In still another preferred embodiment, the plural heat adjusting pass rolls are first, second and third heat adjusting pass rolls. The temperature adjustor includes a first adjusting section for keeping the first heat adjusting pass roll at a low target temperature adapted for drying a first web section included in the continuous material. A second adjusting section adjusts temperature of the second heat adjusting pass roll. A third adjusting section keeps the third heat adjusting pass roll at a high target temperature adapted for drying a second web section which is included in the continuous material, and has lower rapidity in being dried than the first web section. The controller controls the selection mechanism cyclically in first, second, third and fourth steps, and when in the first step, the selection mechanism enables the first heat adjusting pass roll to keep the continuous material at the low target temperature, the second adjusting section heats the second heat adjusting pass roll to a high switching temperature which is higher than the high target temperature. When in the second step, the selection mechanism enables the second heat adjusting pass roll, to heat the continuous material. When the continuous material is set at the high target temperature, the controller starts the third step, the selection mechanism enables the third heat adjusting pass roll, to keep the continuous material at the high target temperature, the second adjusting section cools the second heat adjusting pass roll to a low switching temperature which is lower than the low target temperature. When in the fourth step, the selection mechanism enables the second heat adjusting pass roll, to cool the continuous material. When the continuous material is set at the low target temperature, the controller starts the first step.

Also, a drying method of drying continuous material in a sheet, film or plate form coated with coating liquid is provided. In the drying method, the continuous material is administered by setting the continuous material at a target temperature. It is checked whether a change occurs in a characteristic of the continuous material. If the change occurs in the characteristic, a new target temperature is determined, to set the continuous material at the new target temperature in place of the target temperature, to stabilize drying of the coating liquid.

According to one aspect of the invention, a drying apparatus for drying continuous material in a sheet, film or plate form coated with coating liquid is provided. At least one heat adjusting pass roll is rotatable for contacting the continuous material being transported, the heat adjusting pass roll being controllable for temperature, and having a surface modified layer which is resistant to abrasion, and has a friction coefficient of 0.4 or less in relation to contact with the continuous material.

The at least one heat adjusting pass roll applies heat to the continuous material for drying operation.

Furthermore, a driving pass roll transports the continuous material by rotating. The at least one heat adjusting pass roll is rotated by the continuous material being transported.

Furthermore, a drying zone contains the at least one heat adjusting pass roll, the continuous material being transported through the drying zone.

Furthermore, a heat control device controls a roll surface temperature of the heat adjusting pass roll by using to radiant heat, electric energy, or infrared radiation.

In another preferred embodiment, a heat exchange medium circulator circulates heat exchange medium at a predetermined temperature through a roll conduit inside the heat adjusting pass roll, to control a roll surface temperature of the heat adjusting pass roll.

Furthermore, a thermometer unit measures temperature of the continuous material. A controller adjusts circulation of the heat exchange medium circulator according to the temperature being measured, to control the roll surface temperature of the heat adjusting pass roll.

The surface modified layer comprises a diamond-like carbon layer.

The at least one heat adjusting pass roll comprises plural heat adjusting pass rolls controllable for temperature in an individual manner from one another.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

In a drying apparatus and method of the invention, an example of continuous material or continuous sheet to be heated is web of metal having a small thickness and a great length. Examples of the continuous material of metal include aluminum web, stainless steel in a continuous shape, a steel plate in a continuous shape, an aluminum plate in a continuous shape, and a light alloy plate in a continuous shape.

Figure 3:
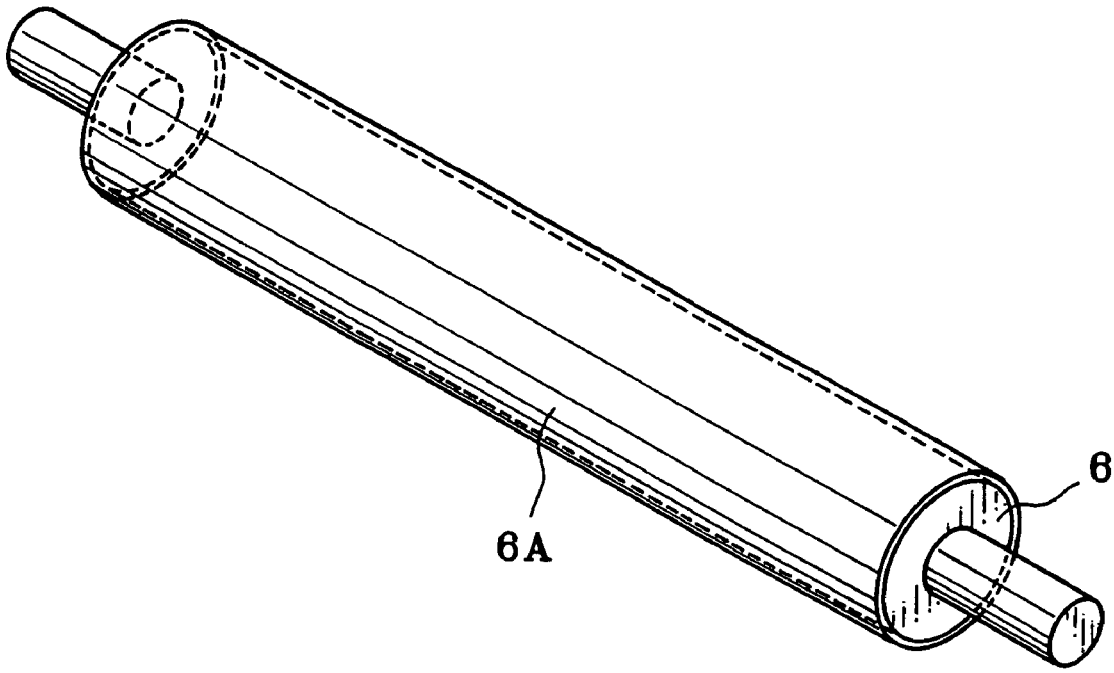
FIG. 3 is a perspective view illustrating another preferred thermal roll having a surface layer.

The outer surface of the thermal roll may be coated with a layer of chromium plating, or other coating of metal on the condition of a friction coefficient between the continuous material and the thermal roll in the range according to the present invention. See FIG. 3. Also, a coating of the thermal roll may be formed of ceramic material, fluorine resin, high-density polyethylene resin, elastomer, and other suitable materials. Furthermore, the roll surface may be a polished surface of metal particularly if the thermal roll is of metal, such as stainless steel, general-purpose steel, and bronze.

According to the invention, stress created between the web and the thermal roll can be very small even if the web contacts the thermal roll at a higher temperature range than the web by 50-100° C. Thus, the dried web can be free from wrinkles, folds, distortions or other damages.

Also, an example of continuous material or continuous sheet to be dried is aluminum web coated with solution for forming a printing plate producing layer. Furthermore, the continuous material may be provided with a coating of painting material, an example of the continuous material being any one of the stainless steel, a steel plate, and an aluminum plate, In FIG. 1, one preferred drying apparatus of the invention is illustrated.

Figure 1:
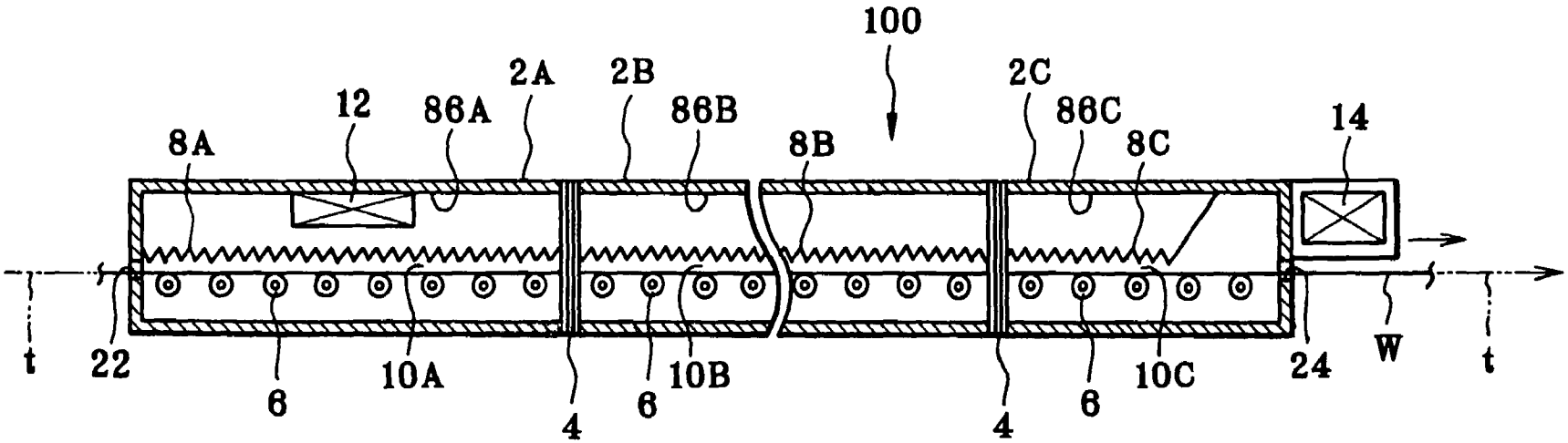
FIG. 1 is a vertical section illustrating a web coating/drying system including a drying apparatus of the invention.

A drying line or drying apparatus 100 according to a first embodiment dries aluminum web W having an upper coated surface coated with solution for forming a printing plate producing layer. In FIG. 1, there are drying boxes 2A, 2B and 2C in the drying line 100 for passage of the aluminum web W. The inside of the drying boxes 2A-2C is connected with one another serially, longitudinally in a feeding direction of the aluminum web W.

Each of the drying boxes 2A-2C have a parallelepipedic shape, and extends in a feeding direction a of feeding the aluminum web W. Connection bellows 4 are used to connect the drying boxes 2A-2C serially with one another, to form a shape of a single long box. An entrance slot 22 is formed in an end panel of the drying box 2A positioned upstream with reference to the feeding direction a, has an edge extending horizontally, and is used for entry of the aluminum web W. An exit slot 24 is formed in an end panel of the drying box 2C positioned downstream with reference to the feeding direction a, has an edge extending horizontally, and is used for ejection of the aluminum web W.

Plural thermal rolls 6 are disposed in a rotatable manner in the drying boxes 2A-2C near to each lower panel of those, for feeding the aluminum web W.

The thermal rolls 6 have the static friction coefficient $\mu_{web}$ determined between its roll surface and a downward directed back surface of the aluminum web W. The thermal rolls 6 are so formed that the static friction coefficient $\mu_{web}$ satisfies the condition of:

$$t+V \leqq G$$

wherein $$\begin{aligned} G &= \mu_{web} \cdot \sigma_{A1} \\ &= \mu_{web} \cdot t \cdot \sin(\theta/2) \end{aligned}$$

where t is tension applied to the aluminum web W;

G is roll retaining force with which the roll surface frictionally retains the aluminum web W;

V is thermal expansion force generated by thermal expansion of the aluminum web W retained on the roll surface;

$\sigma_{A1}$ is pressing force caused by the tension to the aluminum web W and applied to the roll surface by the aluminum web W;

θ is a wrap angle at which the aluminum web W contacts the roll surface.

Also, the thermal rolls 6 are so formed that the static friction coefficient $\mu_{web}$ satisfies the condition of:

$$\sigma_{web}+\alpha_{web}\cdot E_{web}\cdot\Delta T/(1-\nu_{web})\leqq 10/\mu_{web}$$

where $\sigma_{web}$ is stress which the tension t of the aluminum web W creates to the aluminum web W in a direction to press the thermal rolls 6;

$\alpha_{web}$ is coefficient of linear expansion of the aluminum web W;

$E_{web}$ is modulus of elasticity of the aluminum web W in its thickness direction;

ΔT is a difference in the temperature between the thermal rolls 6 and the web before being heated; and $\nu_{web}$ is Poisson ratio of the aluminum web W.

A heat generating element for the thermal rolls 6 can be a device for circulating heat exchange medium, such as warm water, hot water, vapor, and heat exchange oil for the purpose of applying heat. Also, a heat generating element may be an electric device, such as an electromagnetic induction coils and an electric heater. The heat generating element in the thermal rolls 6 may rotate together with its roll body. Also, only the body of the thermal rolls 6 may rotate about the heat generating element, which can be stationary relative to any of the drying boxes 2A-2C.

Figure 2:
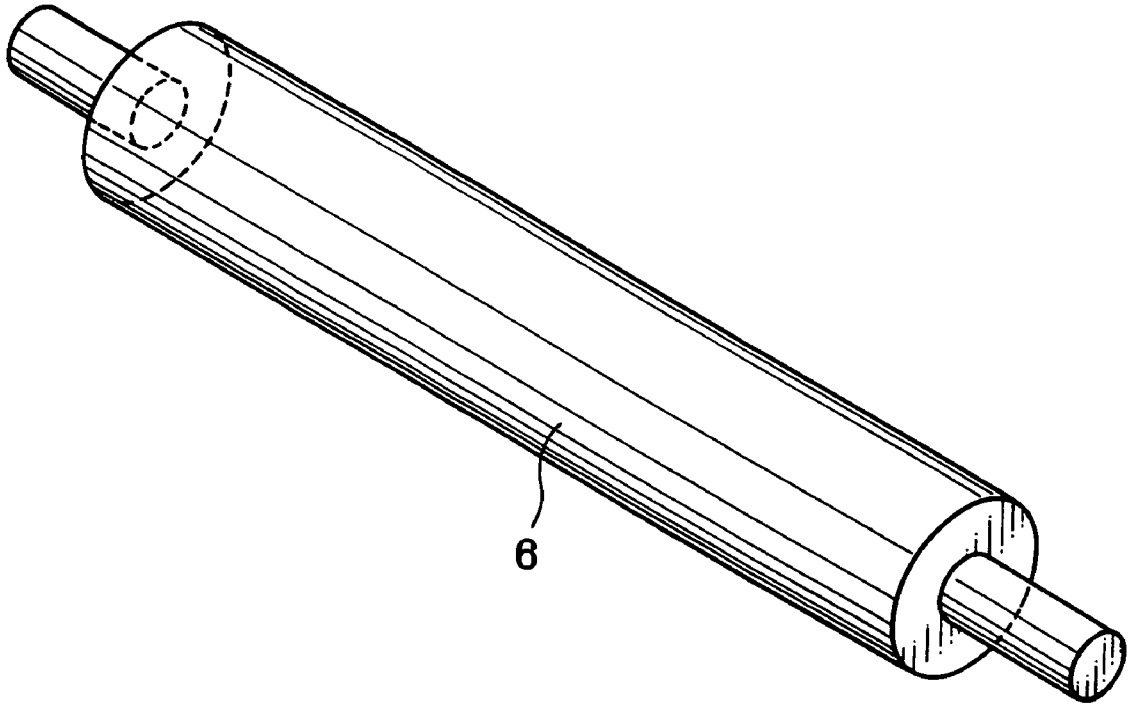
FIG. 2 is a perspective view illustrating a thermal roll included in the drying apparatus.

It is possible as illustrated in FIG. 2 that the body of the thermal rolls 6 does not have an additional surface layer. However, the thermal rolls 6 can be provided with a surface layer for a roll surface 6A. See FIG. 3. The surface layer can be formed from ceramic material, fluorine resin compound and other suitable material.

All of the thermal rolls 6 disposed in sequence have the same diameter and the same height of positioning on the drying boxes 2A-2C. Thus, the aluminum web W is kept flat to extend horizontally while fed.

Hot gas nozzle devices 8A, 8B and 8C are disposed higher than the thermal rolls 6 for blowing hot gas to the upper coated surface of the aluminum web W transported by the thermal rolls 6. Inside the drying boxes 2A-2C, feeding paths 10A, 10B and 10C extending in a feeding direction are defined between the thermal rolls 6 and the hot gas nozzle devices 8A-8C for feeding the aluminum web W. The hot gas nozzle devices 8A-8C constitute an upper limit of the feeding paths 10A-10C.

Figure 4:
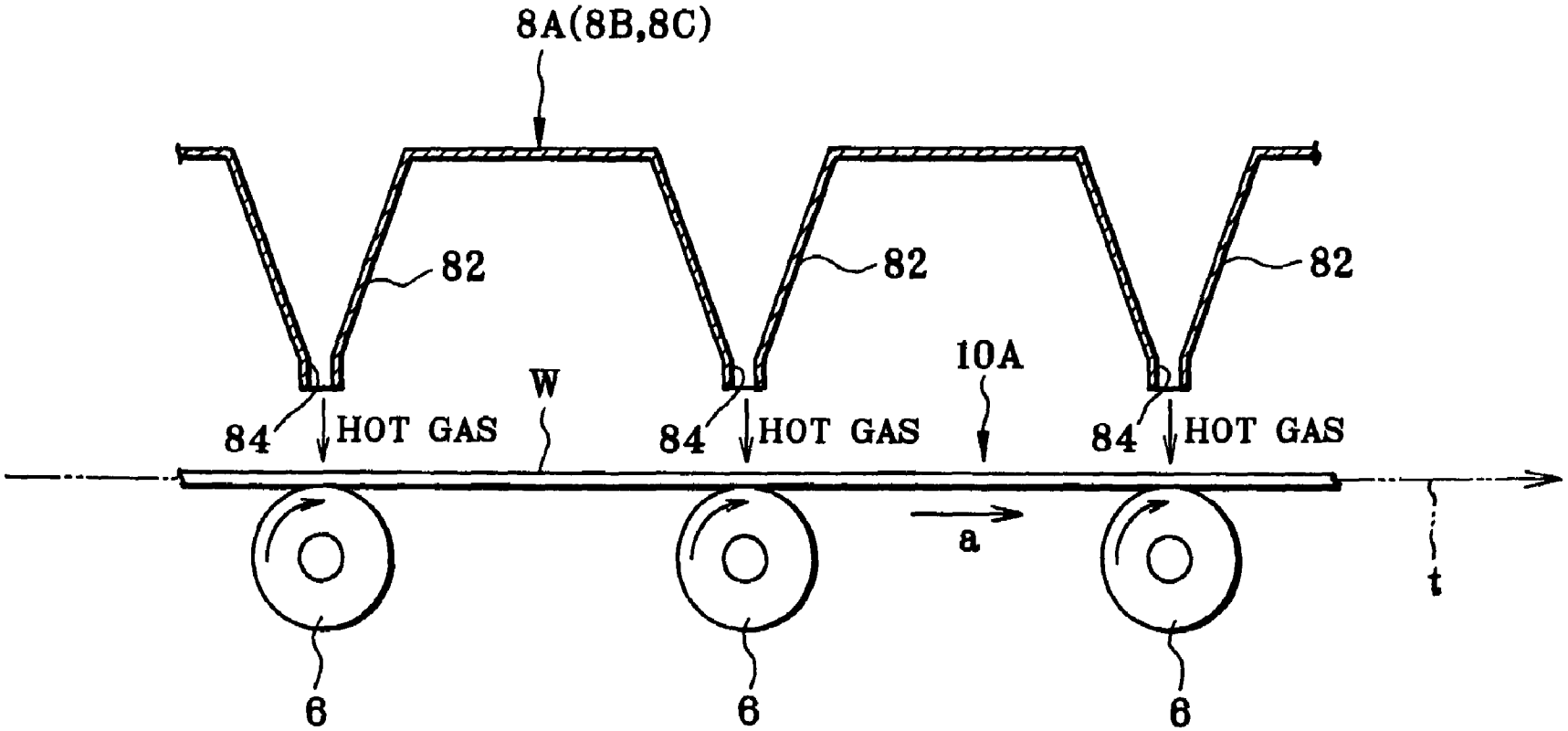
FIG. 4 is an explanatory view in elevation illustrating a hot air nozzle device in the drying apparatus.

The hot gas nozzle devices 8A-8C are two-dimensional nozzles. In FIG. 4, hot gas nozzle chambers 82 are arranged at a regular interval in each of the hot gas nozzle devices 8A-8C, and project downwards and crosswise to the feeding direction a. Nozzles 84 are formed in lower ends of the hot gas nozzle chambers 82, for ejecting hot gas, for example hot air.

Hot gas flowing chambers 86A, 86B and 86C for hot gas or air are defined by an upper panel and lateral panels of the drying boxes 2A-2C and the hot gas nozzle devices 8A-8C, for a flow of the hot gas or air introduced through the hot gas nozzle chambers 82.

The hot gas flowing chambers 86A-86C are connected by the connection bellows 4 to one another, and constitute a single duct for a flow.

There is a hot gas supply device 12 disposed near to the entrance slot 22 in the hot gas flowing chamber 86A, for supplying the hot air to the hot gas flowing chambers 86A-86C.

An exhausting port 14 is formed at an end of the drying box 2C and disposed beside the exit slot 24. The exhausting port 14 is provided with a fan or blower, which exhausts the hot gas in the drying boxes 2A-2C after the entry through the hot gas nozzle devices 8A-8C.

The operation of the drying line 100 is hereinafter described.

The aluminum web W is introduced through the entrance slot 22 into the feeding path 10A, supported and transported by the thermal rolls 6, moved past the feeding paths 10B and 10C, and is exited to the outside through the exit slot 24.

The aluminum web W is heated by the thermal rolls 6 in the upward direction while moved past the feeding paths 10A, 10B and 10C. At the same time, the aluminum web W is heated with the hot gas in the downward direction by the hot gas introduced by the hot gas nozzle devices 8A-8C.

Accordingly, the printing plate producing layer forming solution is efficiently dried on the upper coated surface of the aluminum web W. When the aluminum web W exits through the exit slot 24, a printing plate producing layer is completely formed on the upper coated surface of the aluminum web W. Note that the upper coated surface is a surface subjected to graining in the finish.

The thermal rolls 6 in the drying line 100 are conditioned so that the static friction coefficient $\mu_{web}$ between the roll surface and the aluminum web W satisfies the condition of the mathematical expressions described above.

Let the aluminum web W have temperature of 25° C. before entry to the feeding path 10A. Let the roll surface of the thermal rolls 6 have drying temperature in a range of 75-80° C. Even if the aluminum web W contacts the thermal rolls 6 and is abruptly heated and expanded thermally, there occurs no great stress in the thickness direction of the aluminum web W. As tension of 50-200 kg is applied to the aluminum web W, deformation of the aluminum web W can be prevented effectively by the tension. Thus, the aluminum web W will not be involved with damages or distortions such as wrinkles or folds.

This being so, the thermal rolls 6 can be used even in the drying box 2A which is located in the most upstream position as viewed in the feeding direction a. It is possible quickly to heat the aluminum web W even immediately after entry from the entrance slot 22, because of the high thermal conductivity of the thermal rolls 6.

A flow rate of the hot air entering the drying line 100 through the hot gas nozzle devices 8A-8C can be small and can be enough for substitution of air in the feeding paths 10A-10C to prevent saturation with organic solvent gas gasified from the printing plate producing layer forming solution on the surface of the aluminum web W. This flow rate can be much smaller than a flow rate of gas which would directly blow the layer of printing plate producing layer forming solution for direct drying.

In conclusion, the total of the required energy can be saved in the drying line 100, because the energy used for supplying the hot air can be saved remarkably.

Note that, in the above embodiment, the drying line 100 is disposed downstream from a coating line for coating the aluminum web W with the printing plate producing layer forming solution. However, a drying process of the present invention may be used in the drying line 100 for handling the coated web, and for drying polyvinyl aqueous solution with which the coated web has been coated further, to obtain an oxygen barrier layer.

EXAMPLES

Experiments were conducted regarding Examples 1-4 and Comparative Examples 1 and 2. The aluminum web W was 800 mm wide and 0.1 mm thick, and placed on and transported by the thermal rolls 6 of FIGS. 2 and 3. The tension t applied to the aluminum web W was 150 kg per web width. Occurrence of distortion in the aluminum web W was observed. Results are indicated in Table 1.

TABLE 1

| | Coating of Thermal roll 6 | Friction Coefficient μ | Occurrence of Wrinkles or Distortions |
|---|---|---|---|
| Comparative Example 1 | Phenol resin | 0.78 | Partially Small Distortions |
| Example 1 | Cr plating | 0.7 | None |
| Example 2 | Fluorine resin | 0.25 | None |
| Example 3 | TiC | 0.1 | None |
| Example 4 | DLC | 0.1 | None |
| Comparative Example 2 | Covering of SBR rubber | 0.2 | Distortions on Entire Surface |

As is observed in Table 1, Examples 1-4 had the static friction coefficient $\mu_{web} \leqq 0.7$ determined between the thermal rolls 6 and the downward directed back surface of the web W. Examples 1-4 were successful in preventing occurrence of distortion. In Comparative Examples 1 and 2, in contrast, the static friction coefficient $\mu_{web}$ was either of 0.78 and 1.2 which are higher than 0.7. The Comparative Examples 1 and 2 resulted in occurrence of wrinkles.

The stress $\sigma_{web}$ created in the aluminum web W by the tension t was 17.5 kg/cm$^2$. The coefficient $\alpha_{web}$ of linear expansion of the aluminum web W was $23.5\times10^{-6}$ m/° C. The modulus $E_{web}$ of elasticity of the aluminum web W in its thickness direction was 68.6 kN/mm$^2$. The Poisson ratio $\nu_{web}$ of the aluminum web W was 0.33. Also, the difference ΔT in the temperature between the thermal rolls 6 and the web before being heated was 50° C. Thus, the static friction coefficient $\mu_{web}$ was found 0.7 according to the above-described condition of:

$$\sigma_{web}+\alpha_{web}\cdot E_{web}\cdot\Delta T/(1-\nu_{web})\leqq 10/\mu_{web}$$

As a result of the experiment, Examples 1-4 were acceptable because the static friction coefficient $\mu_{web}$ of those examples was in the acceptable condition mathematically expressed.

In FIGS. 5-10B, other preferred embodiments are described in which the temperature of the web can be efficiently changed even with changes of the characteristic of the web. In a web coating/drying system 110 in FIG. 5, web 111 as continuous material is supplied and transported. There are plural types of the web 111 which are different in the thickness, width, composition, constituent substance or the like. For example, a thin web section 111*a* as a first web section has a small thickness. A thick web section 111*b* as a second web section has a greater thickness than that of the thin web section 111*a*. A splice portion 111*c* splices the thick web section 111*b* with the thin web section 111*a*. A thin web section 111*d* as first web section has the small thickness of the thin web section 111*a*. A splice portion 111*e* splices the thin web section 111*d* with the thick web section 111*b*. A supply roll 112 supplies the web 111 for continuous transport toward an extrusion coater 120. A splice sensor 113 as a signal generator detects the splice portion 111*c* or 111*e*. A result of the detection is sent to a system controller 114, which automatically changes the drying condition in a much efficient manner.

Figure 5:
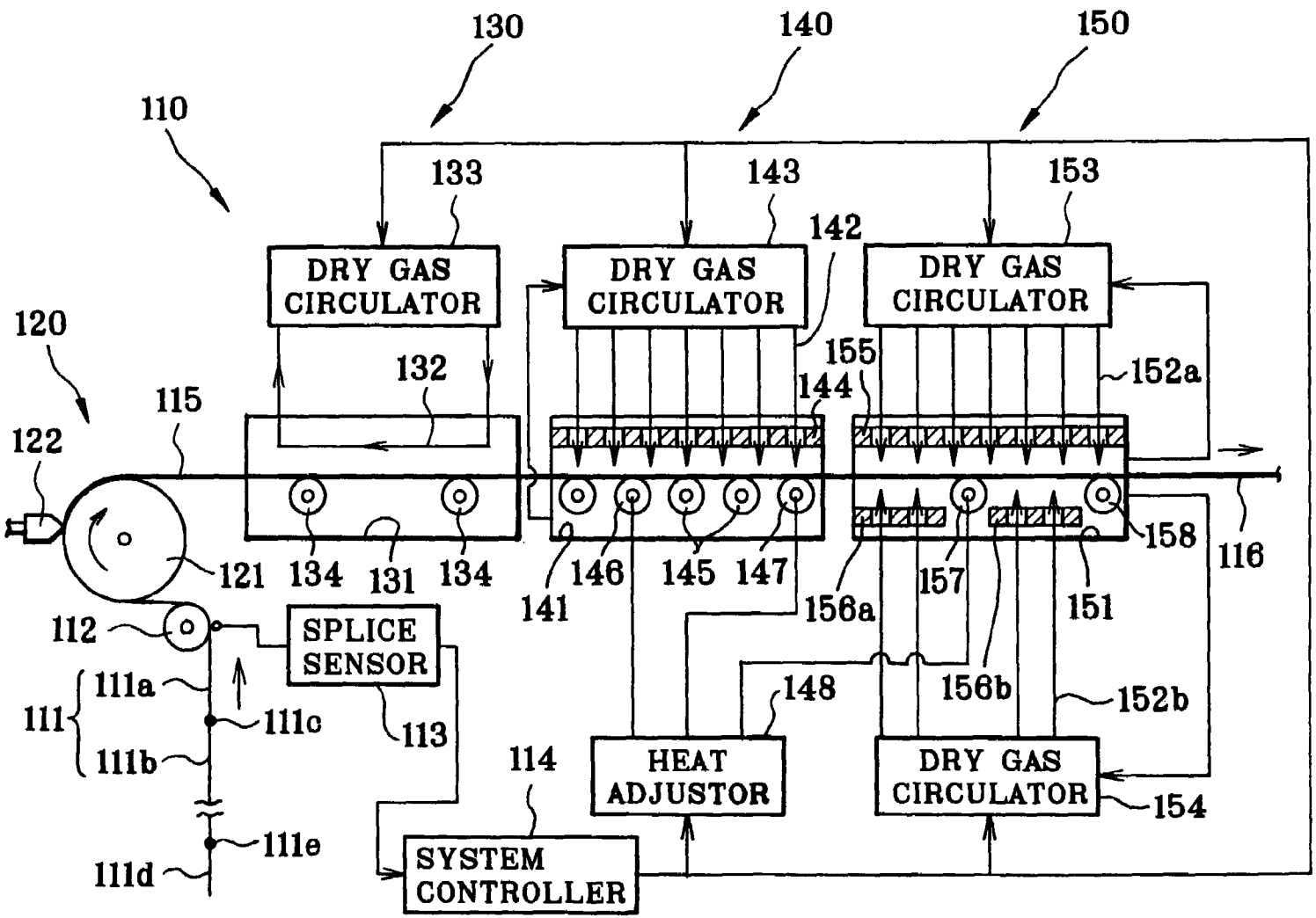
FIG. 5 is an explanatory view in elevation illustrating another preferred drying apparatus in which heat to be applied is adjustable according to a web characteristic.

For supply operation, there is a backup roll 121 in the extrusion coater 120 for continuous feeding the web 111. An extrusion coater die 122 coats the web 111 with coating solution. Note that a term of coated web 115 as continuous material is used for the web obtained by the coating operation to the web 111. In FIG. 5, the extrusion coater 120 operates according to the extrusion coating. However, a coater in the web coating/drying system 110 may be any of other various types, including a roller type, an air knife type, a slide bead coater, curtain coating type, and other known coater.

The web coating/drying system 110 includes a first drying apparatus 130, a second drying apparatus 140, and a third drying apparatus 150. The first drying apparatus 130 is constituted by a drying chamber 131 and a dry gas circulator 133. Dry gas 132 of any suitable substance is circulated by the dry gas circulator 133, and is sent to and from the drying chamber 131. Plural pass rolls 134 are arranged in the drying chamber 131 for feeding the coated web 115 without flexure. Note that the number of the pass rolls 134 is two according to FIG. 5, but may be changed as desired. In an initial step in the drying process, the coated web 115 is kept from direct contact of a thermal, roll. A state of the coating solution on the side of the atmosphere can be stabilized. The dry gas 132 is preferably caused to flow in parallel with the surface of the coated web 115. But the dry gas 132 may be other flow of dry gas. The coated web 115 is dried initially by the first drying apparatus 130, and then moved to the second drying apparatus 140.

The second drying apparatus 140 is also constituted by a drying chamber 141 and a dry gas circulator 143. Dry gas 142 of any suitable substance is circulated by the dry gas circulator 143. A slit-formed panel 144 is disposed in the drying chamber 141 and extends in parallel with the coated web 115. The dry gas 142 is blown through the slit-formed panel 144 and applied to the coated web 115, to encourage gasification of the solution on the coated web 115. To feed the coated web 115, there are pass rolls 145 and thermal pass rolls 146 and 147. A temperature adjustor or heat adjustor 148 is associated with only the thermal pass rolls 146 and 147 included in all the pass rolls. The thermal pass rolls 146 and 147 are adjusted at an optimized temperature according to a characteristic of the web 111. The second drying apparatus 140 promotes dryness of the solution on the coated web 115, before the coated web 115 is fed into the third drying apparatus 150.

A drying chamber 151 is defined inside the third drying apparatus 150. Dry gas circulators 153 and 154 are installed in the drying chamber 151, and send dry gas 152*a* and 152*b* of any suitable substance to both of the coated surface of the coated web 115 and the back surface of the coated web 115. In FIG. 5, a set of the two dry gas circulators 153 and 154 are illustrated. However, a single circulator may be used, of which a flow of the gas may be split into the dry gas 152*a* and 152*b* and sent to the two surfaces of the coated web 115. A slit-formed panel 155 and slit-formed panels 156*a* and 156*b* are disposed in the drying chamber 151 for creating plural flows of dry gas by use of the plural slits. Also, there are a thermal pass roll 157 and a pass roll 158 for contacting the coated web 115. A particular part of the pass rolls is the thermal pass roll 157 connected with the temperature adjustor 148. The use of the thermal pass roll 157 facilitates changes in the drying condition. The coated web 115 dried by the third drying apparatus 150 has a form coated with a layer. Dried web 116 as product is obtained and will be used in subsequent steps.

Figure 6:
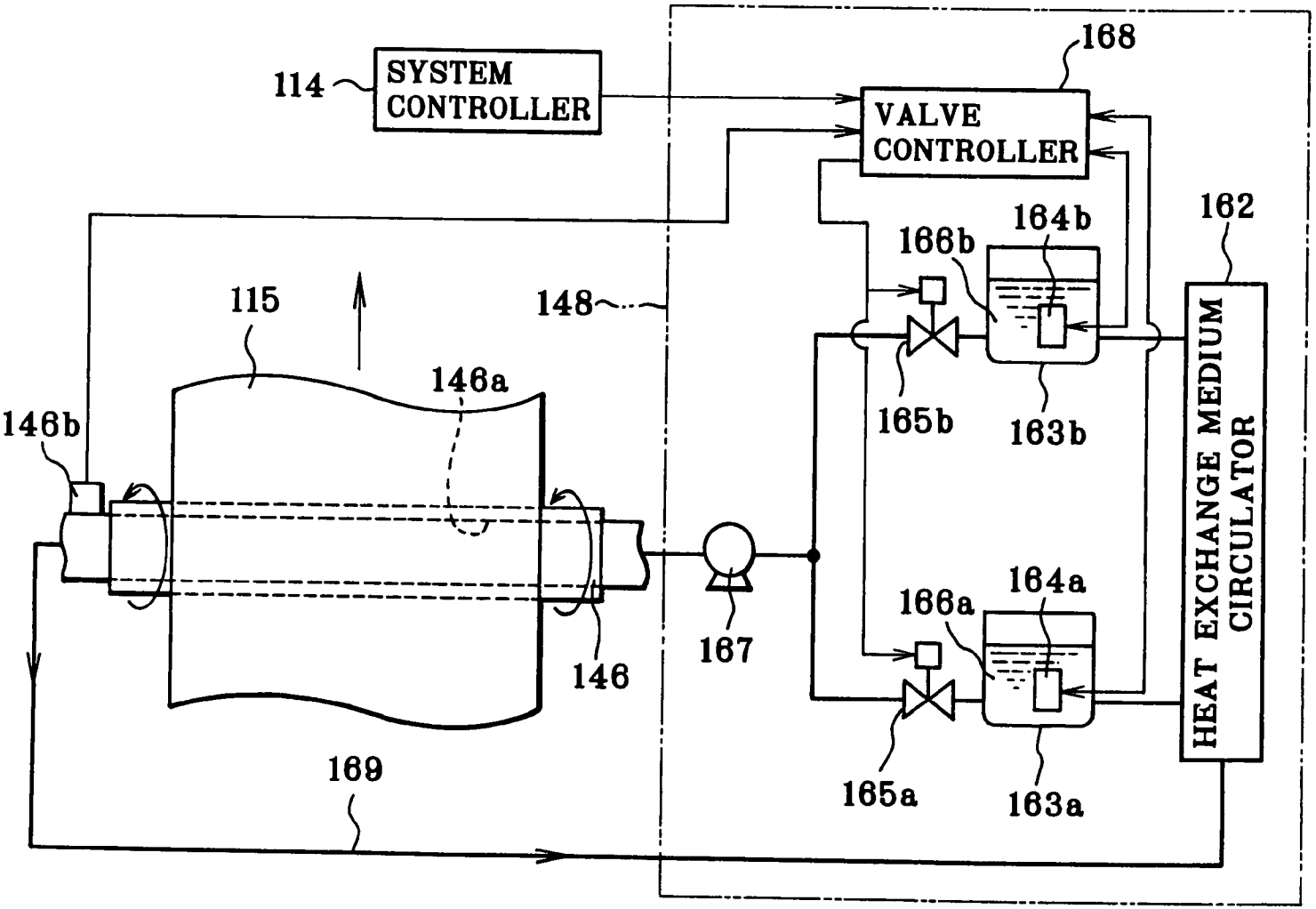
FIG. 6 is an explanatory diagram schematically illustrating a relationship between main elements in the drying apparatus.

Referring to FIG. 6, adjustment of a heat amount is described now. The temperature adjustor 148 is constituted by a heat exchange medium circulator 162, first and second heat exchange medium containers or tanks 163*a* and 163*b*, first and second adjusting sections 164*a* and 164*b*, and valves 165*a* and 165*b*. The heat exchange medium circulator 162 operates as a heat control device, the first heat exchange medium container 163*a* having a first conduit, the second heat exchange medium container 163*b* having a second conduit, and the valves 165*a* and 165*b* constituting a changeable valve mechanism. A preferable example of the valves 165*a* and 165*b* is an electromagnetic changeable valve. A roll conduit 146*a* is formed through the thermal pass roll 146 for a flow of heat exchange medium. Also, a thermometer unit 146*b* is associated with the thermal pass roll 146. First heat exchange medium 166*a* of any suitable fluid is contained in the first heat exchange medium container 163*a*. Second heat exchange medium 166*b* of any suitable fluid is contained in the second heat exchange medium container 163*b*. The first and second heat exchange media 166*a* and 166*b* are kept at their constant temperature by the first and second adjusting sections 164*a* and 164*b*.

A valve controller 168 operates in response to a signal from the system controller 114, and generates a command signal to open either one of the first and second heat exchange media 166*a* and 166*b*. A pump 167 is actuated, and causes one of the first and second heat exchange media 166*a* and 166*b* to flow through the roll conduit 146*a*, to adjust the temperature of the thermal pass roll 146. There is a conduit 169 through which the first or second heat exchange medium 166*a* or 166*b* after passing the roll conduit 146*a* is withdrawn to the heat exchange medium circulator 162. This is advantageous in view of lowering the cost. Note that examples of the heat exchange medium are not limited, but can be suitable types of known fluids including liquids and gases. The heat adjusting condition of the thermal pass rolls 147 and 157 is the same as that of the thermal pass roll 146, and will not be further described.

For the splice portions 111*c* and 111*e*, the connection or splicing requires strength or resistance sufficient for load caused by the transport or winding of the aluminum web W. Examples of the splicing include thermal welding, adhesion with adhesive agent or adhesive tape, or other structures suitable for the aluminum or the like as substance of the web W.

For the purpose of detection, the splice portion 111*c* or 111*e* may be provided with an optical indicia, which can be detected optically by the splice sensor 113 as a photo sensor. Also, a thickness measuring device can be used to measure the thickness of the aluminum web W directly. According to this, it is unnecessary in the system controller 114 to store plural values of the thickness for the plural web types connected serially.

Any of the thermal pass rolls 146, 147 and 157 may be a free roll, or a feeding roll, driven by a drive device, for driving the web. For the adjustment of the heat, heat exchange medium through the pass rolls can be circulated. Examples of the heat exchange medium include vapor, hot water, gas and oil. Other heating processes can be used, examples of which include a process of using radiant heat, for example infrared radiation, and induction heating. Note that it is preferable to adjust the temperature of the roll surface of the thermal pass rolls 146, 147 and 157 for the purpose of adjusting the heat amount of the web.

Forms of the drying apparatuses 130, 140 and 150 can be varied as required for specific purposes, for example, the number of the rolls, the number and positions of the thermal pass rolls, existence or lack of a flow of dry air, and the number of drying apparatuses. The pass rolls 134 and 145, the thermal pass rolls 146 and 147, the thermal pass roll 157, and the pass roll 158 may be provided with known specific structures, for example the material of its body and roll surface, existence or lack of the coating of the roll surface, the material of the coating, the layered structure of the roll. Furthermore, a heat conducting panel may be used for adjusting the drying temperature instead of the rolls. The dry gas 132, 142, 152*a* and 152*b* may be air or any suitable gas, and can be blown by any suitable blowing method known in the art. Also, the circulating operation of the dry gas may be omitted in the first drying apparatus 130, the second drying apparatus 140 and the third drying apparatus 150. The dry gas can be ejected simply through exit openings (not shown).

Operation of the drying according to the invention is described. The aluminum piece of the thin web section 111*a* is 1,000 mm wide and 0.2 mm thick. The aluminum piece of the thick web section 111*b* is 0.5 mm thick. The thick web section 111*b* is connected with the thin web section 111*a* at the splice portion 111*c*. Also, the thin web section 111*d* is connected with the thick web section 111*b* at the splice portion 111*e*, to obtain the web 111. The web 111 is continuously traveled at a speed of 50 meters per minute. For solution to coat, solution for forming a photosensitive layer is used for the purpose of forming photosensitive layer of a presensitized (PS) plate. Then the extrusion coater 120 is actuated to coat the web with solution at a thickness of 1 micron as measured after the drying operation. The temperature of the thermal pass roll 146 is adjusted to set small-thickness target temperature T1=50° C. for drying the thin web section 111*a* having a small thickness. For adjustment of the heat, the first heat exchange medium 166*a* is kept at 50° C. by the first adjusting section 164*a*, and circulated through the roll conduit 146*a*. See FIG. 6. Note that the drying with the thermal pass rolls 147 and 157 is not described further, because the same as the thermal pass roll 146. The temperature of the dry gas 132, 142, 152*a* and 152*b* is adjusted by respectively the dry gas circulators 133, 143, 153 and 154 as corresponding elements.

The system is continuously operated to produce the dried web 116 from the web 111. When the splice portion 111*c* of the web reaches to the measuring position of the splice sensor 113, the splice sensor 113 detects the change in the characteristic of the web, and sends the system controller 114 a detection signal. The system controller 114 controls the dry gas circulator 133, 143, 153 and 154 and the temperature adjustor 148, and adjusts the amount of heat while the thick web section 111*b* is being fed to the extrusion coater 120 and coated with solution.

The temperature of the second heat exchange medium 166*b* is previously adjusted by the second adjusting section 164*b* at a high switching temperature T2=150° C. In response to a signal output by the system controller 114, the valve controller 168 closes the valve 165*a*, opens the valve 165*b* to circulate the second heat exchange medium 166*b* through the roll conduit 146*a*. The temperature of the heat exchange medium is changed from 50° C. to 150° C., so as to heat the thermal pass roll 146 up to the great-thickness target temperature T3=100° C. The temperature of the thermal pass roll 146 is measured by the thermometer unit 146*b*. At the same time, the first heat exchange medium 166*a* is controlled and set by the first adjusting section 164*a* at the great-thickness target temperature T3=100° C. When the thermal pass roll 146 becomes as cool as the small-thickness target temperature T1, the valve controller 168 closes the valve 165*b*, opens the valve 165*a* to circulate the first heat exchange medium 166*a* through the roll conduit 146*a*. The temperature of the thermal pass roll 146 is adjusted to set great-thickness target temperature T3=100° C. for drying the coated web 115. Note that the drying with the thermal pass rolls 147 and 157 is the same as the thermal pass roll 146. The temperature of the dry gas 132, 142, 152*a* and 152*b* is adjusted by respectively the dry gas circulators 133, 143, 153 and 154 in correspondence.

According to the prior art, approximately 40 minutes are required for a change from the small-thickness target temperature T1 to the great-thickness target temperature T3. However, it is possible according to the invention to take time as short as 50 seconds for the purpose of a change to the great-thickness target temperature T3=100° C., because of heating the thermal pass rolls 146, 147 and 157 by use of the high switching temperature T2 higher than the great-thickness target temperature T3, before setting at the great-thickness target temperature T3.

The heat adjustment upon a change from the great thickness to the small thickness is described now. When the splice sensor 113 detects the splice portion 111*e*, the heat adjustment of the thermal pass roll 146 is started in a manner similar to the above. The temperature of the second heat exchange medium 166*b* is previously adjusted by the second adjusting section 164*b* at a low switching temperature T4=20° C. Then the valve controller 168 closes the valve 165*a*, opens the valve 165*b* to circulate the second heat exchange medium 166*b* through the roll conduit 146*a* at the low switching temperature T4=20° C. At the same time, the first heat exchange medium 166*a* is controlled and set by the first adjusting section 164*a* at the small-thickness target temperature T1=50° C. After this, the valve controller 168 closes the valve 165*b*, opens the valve 165*a* to circulate the first heat exchange medium 166*a* through the roll conduit 146*a* at the small-thickness target temperature T1=50° C. Note that the drying with the thermal pass rolls 147 and 157 is the same as the thermal pass roll 146. The temperature of the dry gas 132, 142, 152*a* and 152*b* is adjusted according to the thickness of the web.

According to the prior art, approximately 40 minutes are required for a change from the great-thickness target temperature T3 to the small-thickness target temperature T1. However, it is possible according to the invention to take time as short as 70 seconds for the purpose of a change to the small-thickness target temperature T1=50° C., because of cooling the thermal pass rolls 146, 147 and 157 by use of the low switching temperature T4 lower than the small-thickness target temperature T1, before setting at the small-thickness target temperature T1.

A further preferred process of adjusting a heat amount is possible. Let the small-thickness target temperature T1 be 50° C. Let the great-thickness target temperature T3 be 100° C. To change the temperature, high switching temperature T2 can preferably be 300° C. This is effective in reducing the transition time to as small as 25 seconds from the small-thickness target temperature T1 toward the great-thickness target temperature T3. It is to be noted that, if a change occurs between the web sections regarding the characteristic, heat exchange media of first and second switching temperature are used at excessively higher or lower levels for the purpose of adjusting an amount of heat to be applied to the web. Also in this case, optimized temperature is used for regulation into a range of drying history suitable for maintaining coating performance.

Note that the set of the valves 165*a* and 165*b* is used in the present embodiment. However, a changeable valve mechanism for changing over the plural kinds of the heat exchange media can comprise a three-way valve, or other suitable type of valves.

Figure 7A:
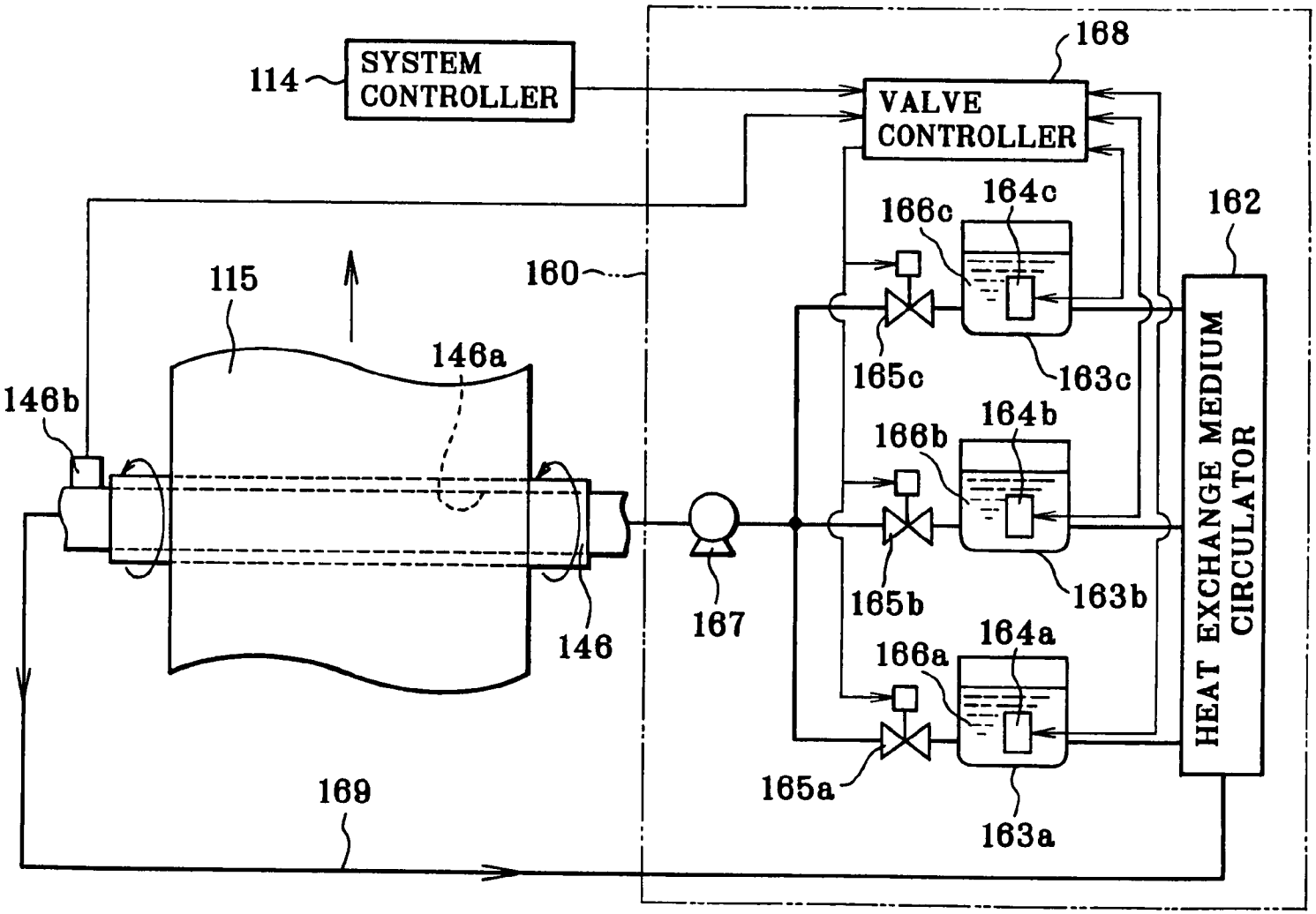
FIG. 7A is an explanatory diagram schematically illustrating one preferred embodiment having three conduits for circulation of heat exchange media.
Figure 7B:
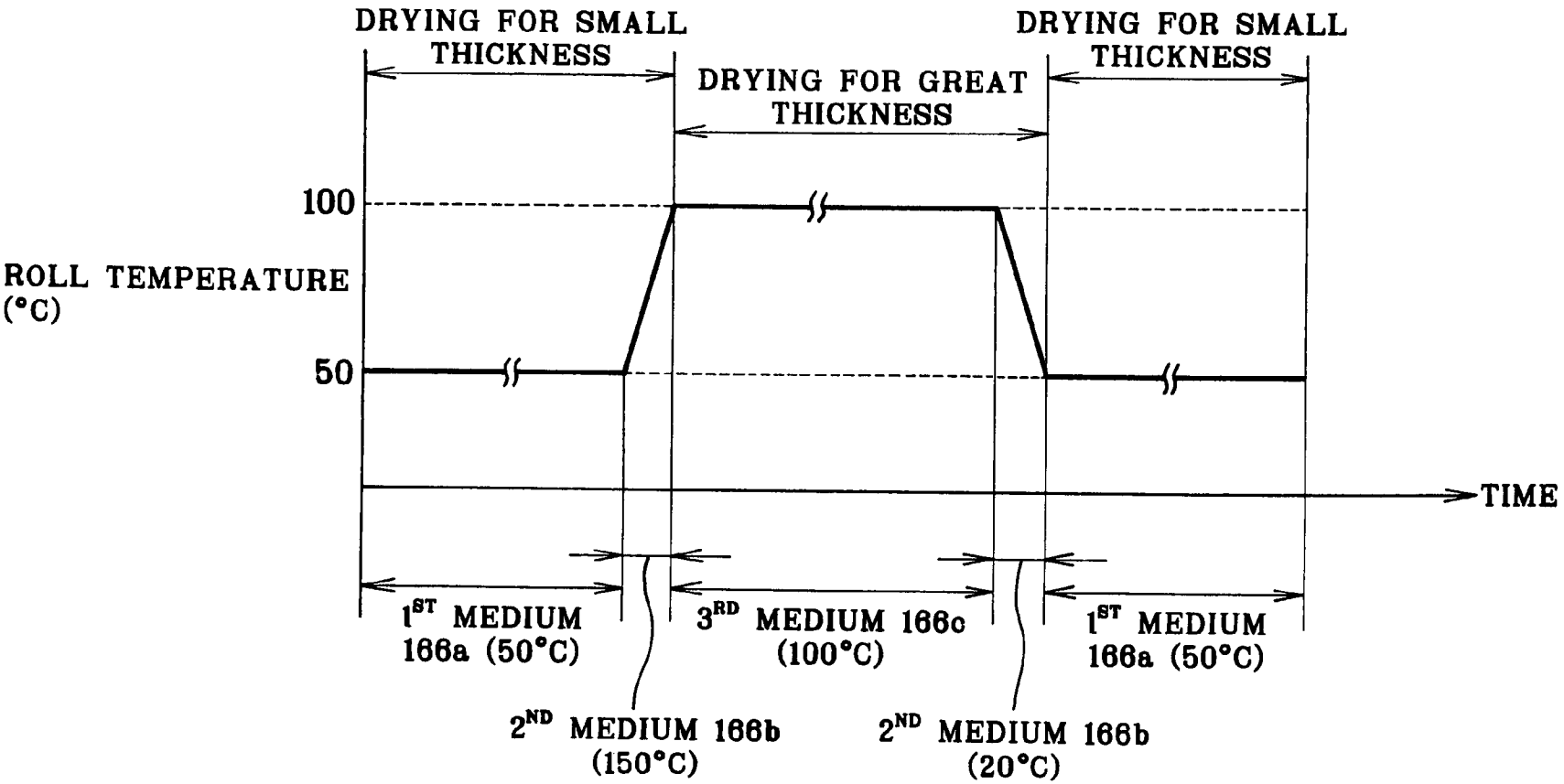
FIG. 7B is a timing chart illustrating sequential flow of the drying apparatus of FIG. 7A.

In FIGS. 7A and 7B, another preferred coater of the invention is illustrated. Elements similar to those in the temperature adjustor 148 are designated with identical reference numerals. A temperature adjustor or heat adjustor 160 of FIG. 7A includes a third heat exchange medium container 163*c*, a third adjusting section 164*c*, and a valve 165*c* in the valve mechanism. The third heat exchange medium container 163*c* has a third conduit. Third heat exchange medium 166*c* of any suitable fluid is further introduced in the roll conduit 146*a* included in the temperature adjustor 148.

The first heat exchange medium 166*a* is adjusted and set by the first adjusting section 164*a* at the small-thickness target temperature T1=50° C. The second heat exchange medium 166*b* is adjusted and set by the second adjusting section 164*b* at the high switching temperature T2=150° C. The third heat exchange medium 166*c* is adjusted and set by the third adjusting section 164*c* at the great-thickness target temperature T3=100° C. While a thin web section of the coated web 115 is coated and dried continuously, the thermal pass roll 146 is kept hot with the first heat exchange medium 166*a* at 50° C. for drying.

When the splice sensor 113 detects a passage of the splice portion 111*c*, the thermal pass roll 146 starts operation of heat adjustment as described above. The valve 165*a* is closed. The valve 165*b* is opened. The second heat exchange medium 166*b* at the temperature of 150° C. is caused to flow through the roll conduit 146*a*, to raise the temperature of the thermal pass roll 146 quickly. The thermometer unit 146*b* detects a reach of the temperature of the thermal pass roll 146 approximately to 100° C. as great-thickness target temperature, and generates a detection signal. The valve controller 168 responsive to the detection signal closes the valve 165*b*, opens the valve 165*a*, causes the third heat exchange medium 166*c* to flow through the roll conduit 146*a*, to keep the thermal pass roll 146 at a constant temperature. It is to be noted that the heat exchange media 166*a*, 166*b* and 166*c* may be preferably withdrawn to the heat exchange medium circulator 162 by utilizing the conduit 169.

As described heretofore, the condition of the drying temperature can be adjusted only in a short time from the small thickness to the great thickness. This is because the thermal pass roll 146 is heated by utilizing the high switching temperature T2 which is sufficiently higher than the great-thickness target temperature T3.

A change in the drying temperature from a level for the great thickness to a level for the small thickness is described now. At first, the second heat exchange medium 166*b* is set at 20° C. as the low switching temperature T4 lower than the small-thickness target temperature T1=50° C. When the splice sensor 113 detects the splice portion 111*e* between the thick and thin web sections, the valve controller 168 closes the valve 165*c*, and opens the valve 165*b* to cause the second heat exchange medium 166*b* to flow through the roll conduit 146*a*. The temperature of the thermal pass roll 146 is lowered and becomes approximately 50° C. that is the small-thickness target temperature. After this, the valve 165*b* is closed. The first heat exchange medium 166*a* at the small-thickness target temperature T1 is caused to flow through the roll conduit 146*a*, to adjust heat generated with the thermal pass roll 146. Accordingly, the change in the condition of the drying temperature can be made only in a short time, because the thermal pass roll 146 is cooled to the small-thickness target temperature T1 by use of the low switching temperature T2 that is lower than the small-thickness target temperature T1 upon the change from the thick web section to the thin web section. Note that the specific features of the experimental condition above, including the great or small-thickness target temperature and switching temperature, are only example values. Various modifications are possible.

Figure 8:
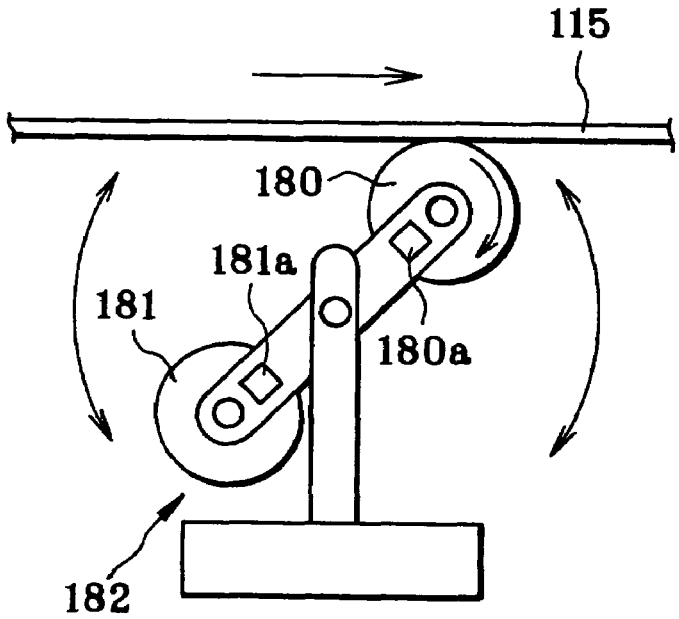
FIG. 8 is a front elevation illustrating another preferred embodiment in which two thermal pass rolls generates heat at different temperatures.

In FIG. 8, another preferred drying apparatus of the invention is described now. A temperature adjustor or heat adjustor includes thermal pass rolls 180 and 181, a selection mechanism 182, and heat control devices 180*a* and 181*a*. The selection mechanism 182 is operable, changes over the thermal pass rolls 180 and 181, and directs a selected one of those to the coated web. The heat control devices 180*a* and 181*a* are associated with respectively the thermal pass rolls 180 and 181, and adjust their temperature independently from one another. Thus, the temperature adjustor is constructed to change heat applied to the coated web.

A changing process of the drying temperature from the small-thickness target temperature T1 up to the great-thickness target temperature T3 is described now. At first, the thermal pass roll 180 is set at the small-thickness target temperature T1, for example 50° C., and contacts the thin web section in the coated web 115, and dries the same. At the same time, the thermal pass roll 181 is set at the high switching temperature T2, for example 150° C., by the heat control device 181*a*. When the web is changed over from the small thickness to the great thickness, the thermal pass roll 180 is moved away from the coated web 115. Instead, the thermal pass roll 181 is set in contact with the coated web 115. The temperature of the coated web 115 is abruptly raised. At the same time, the temperature of the thermal pass roll 180 is changed by the heat control device 180*a* to the great-thickness target temperature T3=100° C. After the drying temperature for the coated web 115 comes up to nearly the great-thickness target temperature T3, the thermal pass roll 181 is moved away from the coated web 115. Instead of this, the thermal pass roll 180 is set in contact with the coated web 115. This being so, the drying temperature can be adjusted shortly by adjusting the heat amount.

Also, a change from the great-thickness target temperature T3 down to the small-thickness target temperature T1 is possible similarly. At first, the thermal pass roll 180 is set at the great-thickness target temperature T3=100° C., and contacts the thin web section in the coated web 115, and dries the same. At the same time, the thermal pass roll 181 is set at the low switching temperature T4=20° C., by the heat control device 181*a*. When the web is changed over from the great thickness to the small thickness, the thermal pass roll 180 is moved away from the coated web 115. Instead, the thermal pass roll 181 is set in contact with the coated web 115. The temperature of the coated web 115 is abruptly lowered. At the same time, the temperature of the thermal pass roll 180 is changed by the heat control device 180*a* to the small-thickness target temperature T1=50° C. After the drying temperature for the coated web 115 comes up to nearly the small-thickness target temperature T1, the thermal pass roll 181 is moved away from the coated web 115. Instead of this, the thermal pass roll 180 is set in contact with the coated web 115. This being so, the drying temperature can be adjusted shortly.

In FIG. 8, still another preferred drying structure is illustrated. The thermal pass roll 180 is conditioned at the small-thickness target temperature T1, and kept in contact with the coated web 115. The thermal pass roll 181 is conditioned at the great-thickness target temperature T3. When a change is made from the small thickness to the great thickness, the thermal pass roll 180 is moved away from the coated web 115. The thermal pass roll 181 is instead caused to contact the coated web 115. The temperature of the coated web 115 being heated is instantaneously changed. Thus, the heat adjustment can be effected at a short time.

Also, a change from the great-thickness target temperature T3 down to the small-thickness target temperature T1 is similar. The thermal pass roll 180 is conditioned at the great-thickness target temperature T3, and kept in contact with the coated web 115. The thermal pass roll 181 is conditioned at the small-thickness target temperature T1. When a change is made from the small thickness to the great thickness, the thermal pass roll 180 is moved away from the coated web 115. The thermal pass roll 181 is instead caused to contact the coated web 115. The temperature of the coated web 115 being heated is instantaneously changed. Thus, the heat adjustment can be effected quickly.

Figure 9:
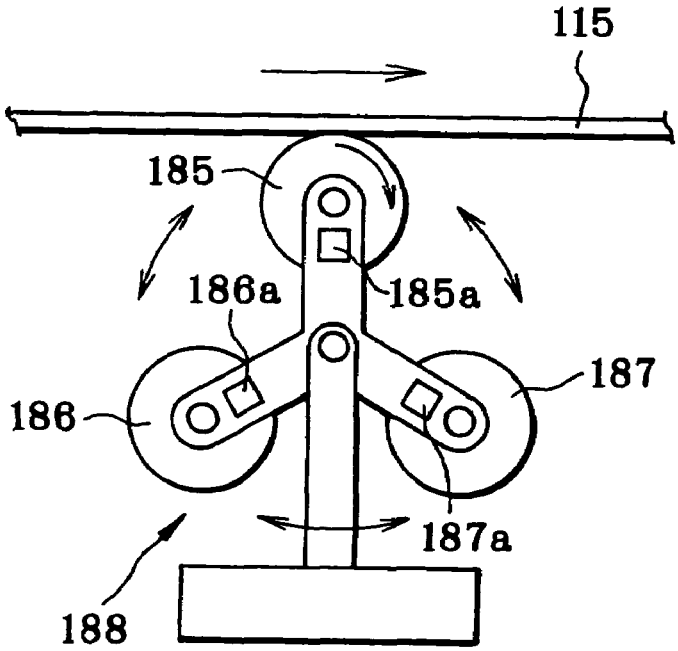
FIG. 9 is a front elevation illustrating an additional preferred embodiment in which three thermal pass rolls generates heat differently.

In FIG. 9, a further preferred drying apparatus of the invention is illustrated. A temperature adjustor or heat adjustor includes three thermal pass rolls 185, 186 and 187 and a selection mechanism 188. Heat control devices 185*a*, 186*a* and 187*a* are connected with respectively the thermal pass rolls 185-187, and control the temperature of those individually from one another. A change from the small thickness to the great thickness is described at first in relation to drying the coated web 115. The thermal pass roll 185 is kept by the heat control device 185*a* at the small-thickness target temperature T1, and is caused to contact the coated web 115 to dry the same. The temperature of the thermal pass roll 186 is changed by the heat control device 186*a* at the high switching temperature T2. Upon changing over the thickness between sections in the coated web 115, the thermal pass roll 185 is moved away from the coated web 115, with which the thermal pass roll 186 comes in contact, to raise the temperature of the coated web 115 in a short time. The temperature of the thermal pass roll 187 is set at the great-thickness target temperature T3 by the heat control device 187*a*. After the temperature of the coated web 115 comes up to approximately the great-thickness target temperature T3, the thermal pass roll 186 is moved away from the coated web 115, with which the thermal pass roll 187 comes in contact. Thus, the change in the temperature can be quick.

With the selection mechanism 188, a change from the great thickness to the small thickness is described now in relation to drying. The thermal pass roll 187 is kept at the great small-thickness target temperature T3, and is caused to contact the coated web 115 to dry the same. The temperature of the thermal pass roll 186 is changed by the heat control device 186*a* to the low switching temperature T4. Upon changing over the thickness between sections in the coated web 115, the thermal pass roll 187 is moved away from the coated web 115, with which the thermal pass roll 186 comes in contact, to drop the temperature of the coated web 115 in a short time. The temperature of the thermal pass roll 185 is set at the small-thickness target temperature T1. After the temperature of the coated web 115 comes down to approximately the small-thickness target temperature T1, the thermal pass roll 186 is moved away from the coated web 115, with which the thermal pass roll 185 comes in contact. Thus, the change in the temperature can be quick.

Consequently, it is possible with the selection mechanism 182 or 188 in the drying apparatus 140 or 150 to facilitate the heat adjustment of the pass rolls in response to the change in the characteristic of the web sections. Note that, for the purpose of heat adjustment of the thermal pass rolls 180 and 181, the thermal pass rolls 185-187 in the selection mechanism 182 or 188 may be effected in a position offset from contact with the coated web 115 and at the time during changing over of the pass rolls, as described above. Alternatively, the pass rolls can be adjusted and set at the prescribed temperature, before being used for drying the coated web. Also, a selecting structure other than that depicted in FIGS. 4 and 5 may be used for changing over pass rolls of which the temperature is adjusted.

Figure 10A:
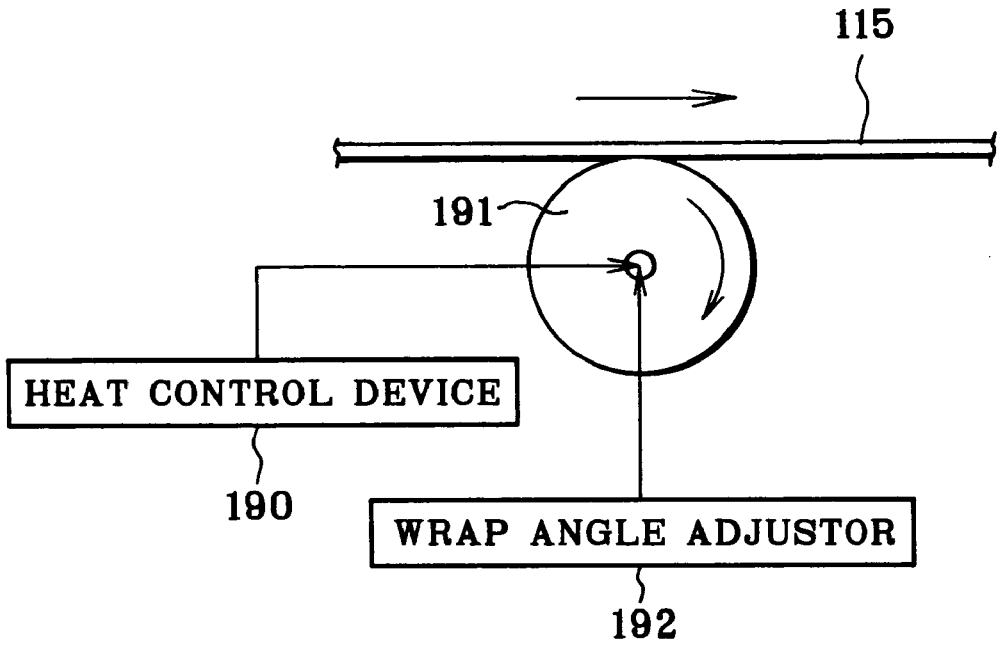
FIG. 10A is an explanatory view in elevation illustrating another preferred embodiment having a wrap angle adjustor for heat adjustment.
Figure 10B:
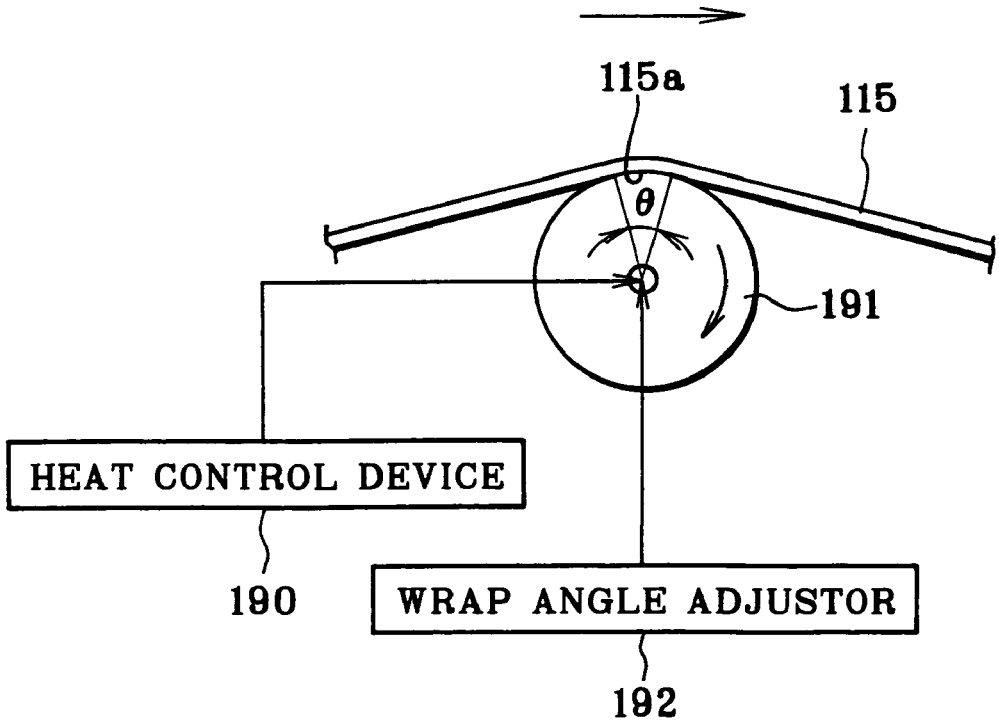
FIG. 10B is an explanatory view in elevation illustrating the same as FIG. 10A but where an area of applying heat is enlarged.

In FIGS. 10A and 10B, one preferred drying apparatus of the invention is illustrated. In FIG. 10A, a temperature adjustor or heat adjustor includes a thermal pass roll 191 and a heat control device 190. The thermal pass roll 191 contacts the coated web 115, and dries the solution as coating. In FIG. 10B, adjustment of the heat is illustrated. A wrap angle adjustor 192 as another heat control device adjusts a wrap angle θ where the thermal pass roll 191 contacts the coated web 115. This changes a wrap contact area 115*a*, to adjust heat applied to the coated web 115. Note that it is possible for the heat control device 190 to vary the heat amount in addition to the control of the wrap angle. Also, the heat control device 190 may be a device for circulating heat exchange medium through the thermal pass roll 191, a heater for electrically generating heat with a resistor, or other suitable heating device.

In FIGS. 11-14, other preferred embodiments are illustrated, in which the web can be dried even if there occurs a change in the size between the web sections. Web or continuous material may be metal, or material other than metal. A term of friction coefficient is hereinafter used to mean static friction coefficient.

The number of thermal pass rolls used herein may be two or more, and can be only one. The thermal pass rolls can be produced from any suitable material. A structure of the thermal pass rolls, and a method of forming a surface modified layer of those may be any suitable type known in the art of the pass roll. Solvent included in the solution to be coated and dried may be water or easily available liquid, but can be any suitable solvent.

To monitor the temperature, an infrared radiation thermometer unit is preferably used. Also, other devices for measuring the temperature can be used, for example a thermography for detecting two-dimensional distribution of the temperature for the entire area of the surface of the web.

Description of the embodiments for the above purpose is as follows.

Figure 11:
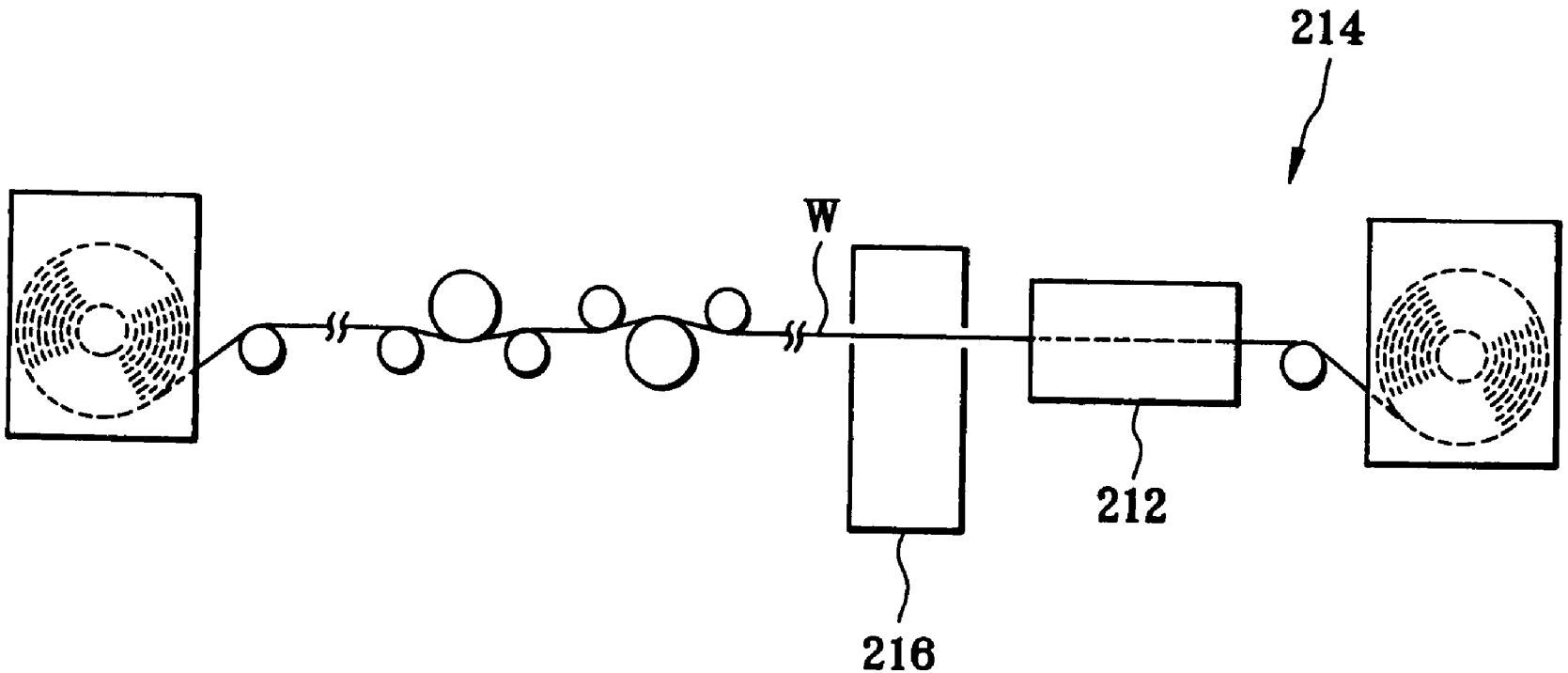
FIG. 11 is a front elevation illustrating another preferred drying apparatus of the invention.

In FIG. 11, a web coating/drying system 214 includes a coater 216 and a drying apparatus 212. The coater 216 is supplied with web unwound from a roll, and coats the web with solution. The drying apparatus 212 dries the solution on the web, which is wound again as a product.

Figure 12:
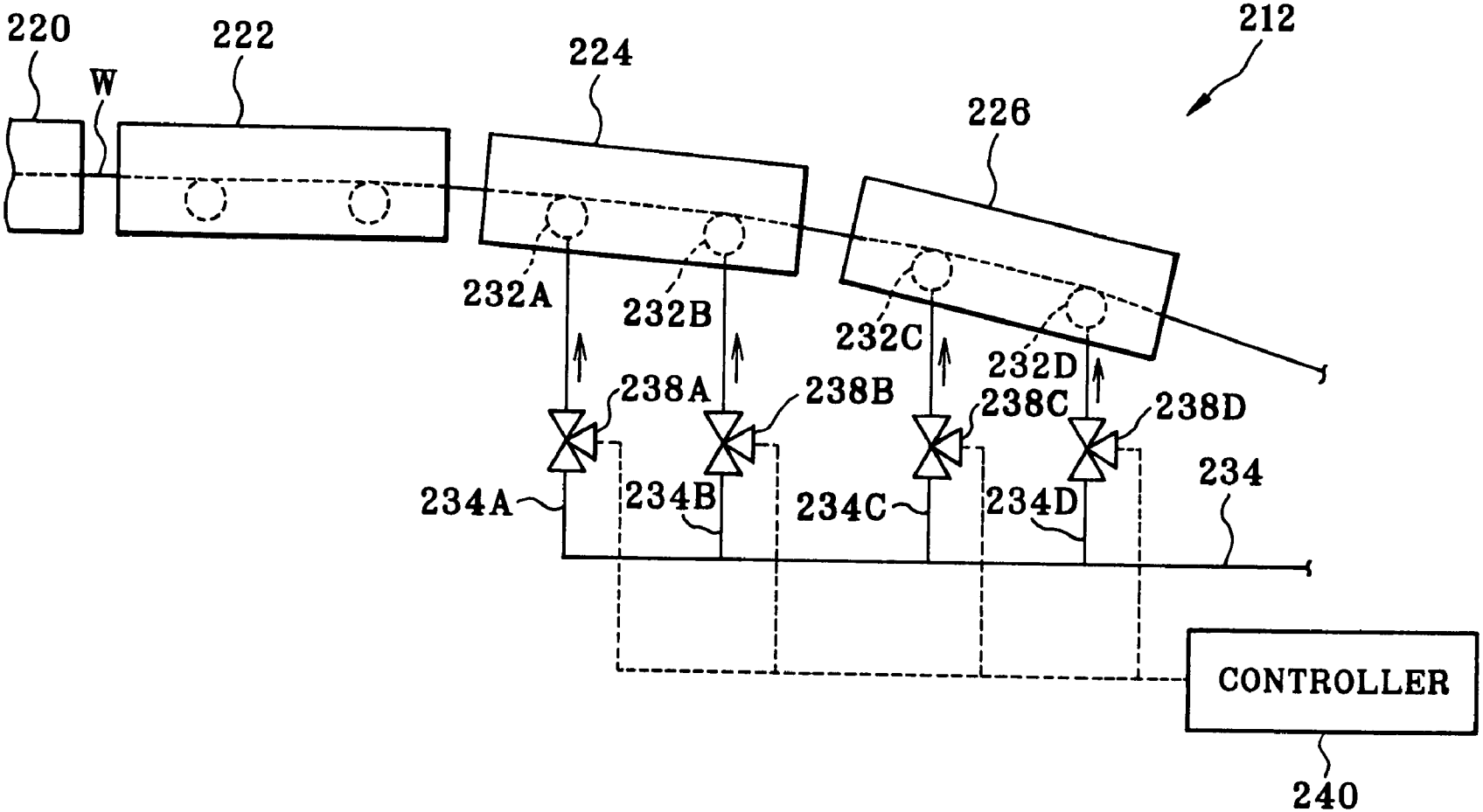
FIG. 12 is an explanatory diagram, partially cutaway, schematically illustrating various elements in the drying apparatus, including pass rolls having small friction.

In FIG. 12, the drying apparatus 212 includes plural drying zones or drying boxes 220, 222, 224 and 226. There are two pass rolls or feeding rolls disposed inside each of the drying boxes 220, 222, 224 and 226. Thermal pass rolls 232A and 232B are contained in the drying box 224, and are controllable for the temperature. Thermal pass rolls 232C and 232D are contained in the drying box 226, and are controllable for the temperature.

Figure 13:
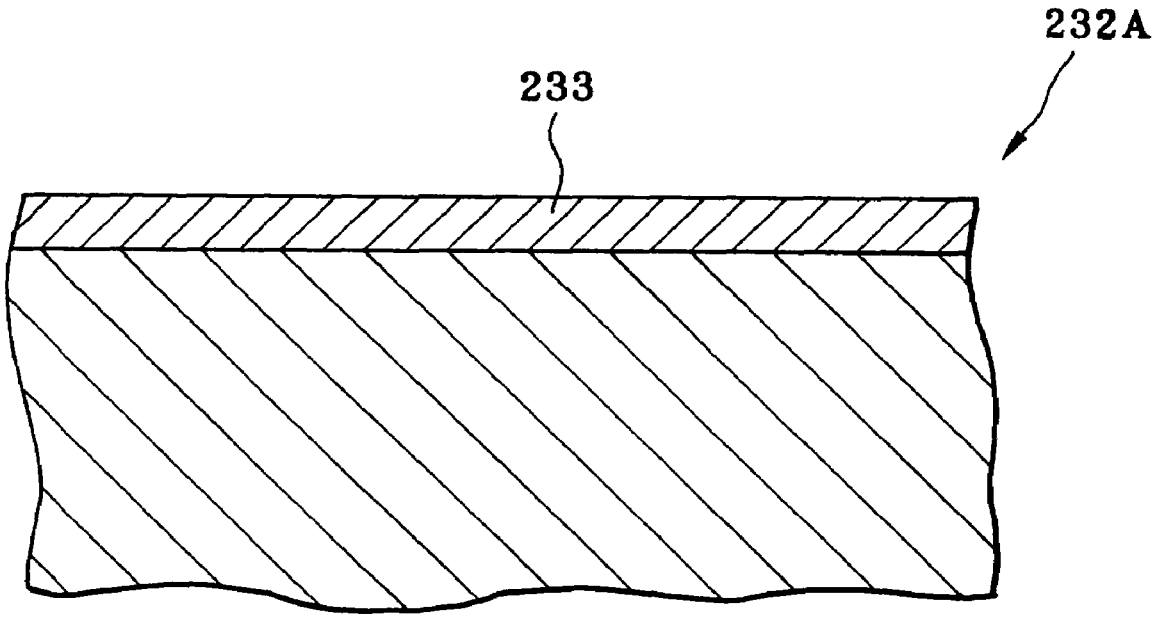
FIG. 13 is a cross section, partially cutaway, illustrating the pass roll having a surface modified layer.

In FIG. 13, a diamond-like carbon layer (DLC) 233 as a surface modified layer is overlaid on a roll body of the thermal pass roll 232A. The DLC layer 233 is effective in preventing scratches or damages on the web W even upon its expansion or shrinkage in contact on the thermal pass roll 232A. Similarly, the DLC layer 233 is provided in the thermal pass rolls 232B-232D.

A heat exchange vapor circulating conduit 234 in a heat exchange medium circulator is provided in the drying apparatus 212 for supply of aqueous vapor for the purpose of heating. Conduits 234A, 234B, 234C and 234D of branches are used to connect the thermal pass rolls 232A-232D with the heat exchange vapor circulating conduit 234. The thermal pass rolls 232A-232D are heated by the hot vapor supplied by the conduits 234A-234D.

A valve 238A of an opening variable type is connected with the conduit 234A. Valves 238B, 238C and 238D of an opening variable type are connected similarly with the conduits 234B-234D. The valves 238A-238D constitute a changeable valve mechanism. A controller 240 is included in the drying apparatus 212, controls the openness of the valves 238A-238D.

To dry the solution on the aluminum web W in the drying apparatus 212, changes in the width, thickness or the like of the aluminum web W are previously estimated. According to the results of the estimation, amounts of the vapor for the thermal pass rolls 232A-232D are adjusted, so as to quicken the heat adjustment of the aluminum web W even upon occurrence of such changes in the width, thickness or the like.

It follows that the drying apparatus 212 capable of quick adjustment of the temperature of the aluminum web W can be obtained by simply adding heating elements to the known drier without adding an extra drying device. As a heat generating source, vapor is sent into the thermal pass rolls 232A-232D. Each of the thermal pass rolls 232A-232D does not include heat generating source themselves. Thus, the thermal pass rolls 232A-232D can be structured in a lightweight manner. If a wrap angle of those is very small, it is possible to prevent slip of the web. Note that heat exchange medium other than the aqueous vapor may be used for heating.

Example

The aluminum web W was 220 mm wide. The thickness of the aluminum web W changed from 0.15 mm to 0.3 mm. Time required for a reach to the target temperature for drying was experimentally measured, in first and second conditions, the first being in use of the drying apparatus 212, and the second being in use of the drying apparatus according to the prior art. In any of the two conditions, a flow rate of the hot gas was kept unchanged. Time required after applying the solution until the reach to a position for drying was 25 seconds. The web section that was 0.15 mm thick was heated at 110° C. The web section that was 0.3 mm thick was controlled for the target temperature of 110° C. Conditions and results of the experiments are indicated in Table below.

| | | Example 1 | | Example 2 | |
|---|---|---|---|---|---|
| Temperature was initially adjusted by | | Hot gas | | Hot gas | |
| Temperature was secondly adjusted by | | Hot gas & pass rolls | | Hot gas | |
| Thickness of web W (mm) | | 0.15 | 0.3 | 0.15 | 0.3 |
| Temperature of hot gas (° C.) | | 120 | 120 | 120 | 140 |
| Temperature of pass rolls (° C.) | Pass roll 232A | None | 100 | None | None |
| | Pass roll 232B | None | 110 | | |
| | Pass roll 232C | None | 120 | | |
| | Pass roll 232D | None | 140 | | |
| Time for passage from coater to drier (sec.) | | 25 | 25 | 25 | 25 |
| Time for heating of 0.3 mm-thick web W to target temperature (min.) | | None | Under 5 | None | 30 |
| Quality of photosensitivity | | Good | Good | Good | Good |

In Example 1 with the drying apparatus 212, the hot gas was kept at 120° C. without a change. The thermal pass rolls 232A-232D were controlled and set at respectively 100° C., 110° C., 120° C. and 140° C. As a result, time of five (5) minutes was taken for the reach of the aluminum web W up to 110° C. upon a change of its thickness to 0.3 mm.

In Example 2 of the prior art in which the temperature of the pass rolls was not controllable, the temperature of the hot gas was controlled and changed from 120° C. to 140° C. As a result, time of 30 minutes was taken for the reach of the aluminum web W up to 110° C. upon a change of its thickness to 0.3 mm.

According to the drying apparatus 212 of Example 1, time for the heat adjustment of the aluminum web W was considerably reduced in comparison with the drier of the prior art. The speed of processing was highly raised.

Figure 14:
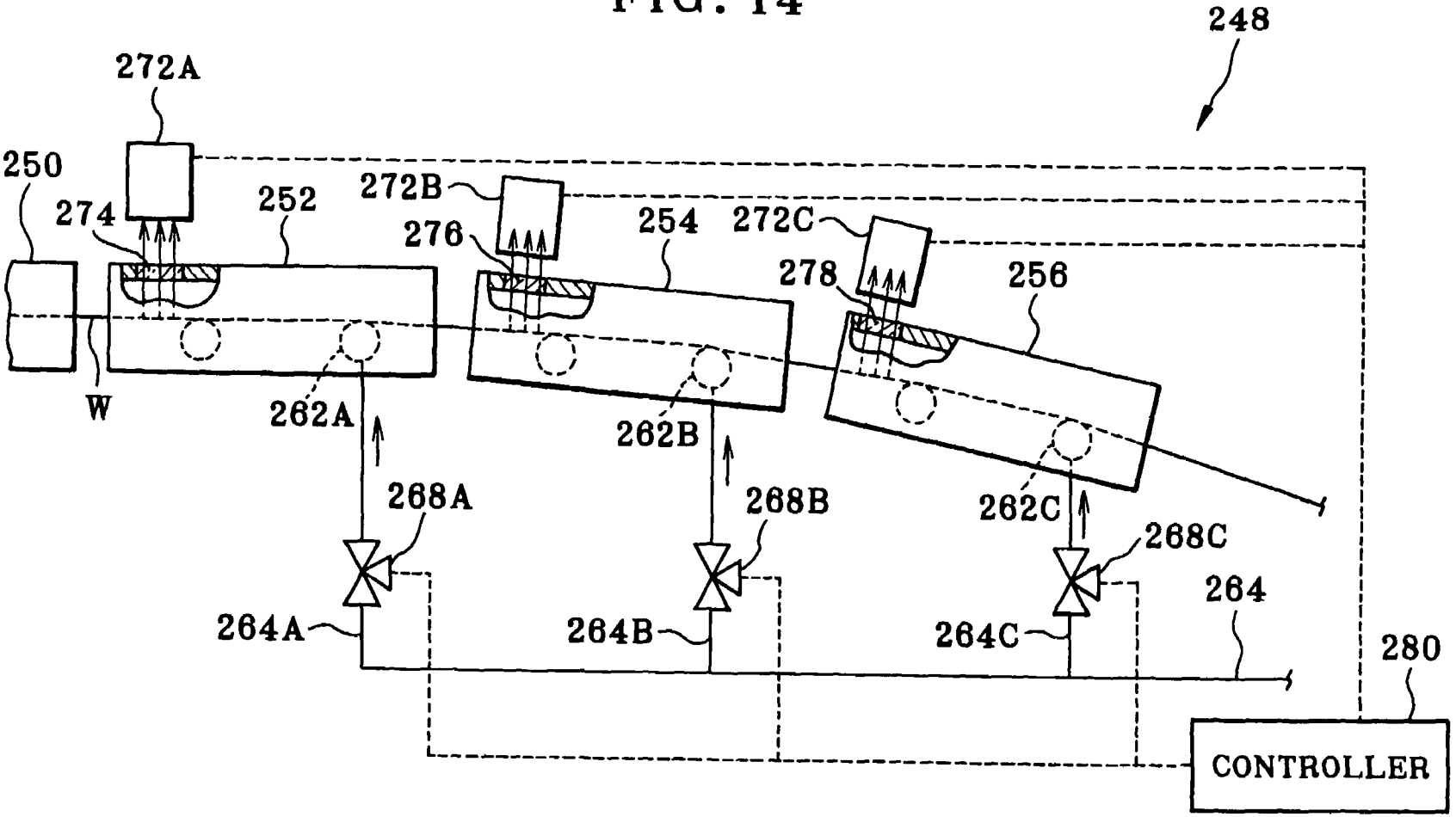
FIG. 14 is an explanatory diagram, partially cutaway, schematically illustrating one preferred drying apparatus in which thermometer units are used for feedback control.

One other preferred embodiment is hereinafter described. In FIG. 14, a drying apparatus 248 includes plural drying zones or drying boxes 250, 252, 254 and 256. There are two pass rolls or feeding rolls disposed inside each of the drying boxes 250, 252, 254 and 256. A thermal pass roll 262A is contained in the drying box 252, is disposed near to its downstream end, and is controllable for the temperature. Thermal pass rolls 262B and 262C are contained in the drying boxes 254 and 256, are disposed near to their downstream end, and are controllable for the temperature.

A heat exchange vapor circulating conduit 264 in a heat exchange medium circulator is provided in the drying apparatus 248 for supply of high-temperature vapor for the purpose of heating. Conduits 264A, 264B and 264C of branches are used to connect the thermal pass rolls 262A-262C with the heat exchange vapor circulating conduit 264. The thermal pass rolls 262A-262C are heated by the hot vapor supplied by the conduits 264A-264C.

A valve 268A of an opening variable type is connected with the conduit 264A. Valves 268B and 268C of an opening variable type are connected similarly with the conduits 264B and 264C. The valves 268A-268C constitute a changeable valve mechanism.

An infrared radiation thermometer unit 272A is provided in the drying apparatus 248 for monitoring infrared radiation emitted by the web section positioned at an upstream end of the drying box 252 and for converting the infrared radiation to temperature. A quartz glass window 274 is attached to the drying box 252 and fitted in a window opening in an upper panel, and allows transmission of the infrared radiation. Similarly, infrared radiation thermometer units 272B and 272C in the drying apparatus 248 monitor infrared radiation emitted by the web section positioned at an upstream end of the drying boxes 254 and 256. Quartz glass windows 276 and 278 are attached to the drying boxes 254 and 256, and allow transmission of the infrared radiation.

A controller 280 is included in the drying apparatus 248 for controlling the temperature of the thermal pass rolls 262A-262C by adjusting the openness of the valves 268A-268C according to a signal of temperature output by the infrared thermometer units 272A-272C. Note that operation of control of the controller 280 may be an open loop control, feedback control or any suitable control.

According to the drying apparatus 248, therefore, the web temperature is monitored in any of the drying boxes. The temperature of the thermal pass rolls 262A-262C is controlled on the basis of the web temperature. Even if an unexpected change occurs in the width, thickness or the like of the web W, the web temperature can be adjusted automatically and quickly to reach the target temperature. In comparison with the construction of FIG. 12, a difference in the amount of heat is remarkably high at an initial step of starting of the manufacturing line, or immediately after the change of the web thickness. It is necessary precisely to control the temperature of the thermal pass rolls 262A-262C so as to suppress extreme changes in the web temperature. However, the construction of FIG. 14 is considerably effective in facilitating the precise control of the roll surface temperature. Furthermore, the web temperature is monitored by the infrared thermometer unit 272A near to the upstream end of the drying box 252. The temperature of the thermal pass roll 262A can be adjusted according to the detected web temperature in the drying box 252. This effect is the same in the drying boxes 254 and 256.

Example

The aluminum web W was 220 mm wide. The thickness of the aluminum web W changed from 0.15 mm to 0.3 mm. Time required for a reach to the target temperature for drying was experimentally measured, in third and fourth conditions, the third being in use of the drying apparatus 212, and the fourth being in use of the drier according to the prior art. In any of the two, a flow rate of the hot gas was kept unchanged. Speed of the transport was 50 meters per minute. Time required after applying the solution until the reach to a position for drying was 25 seconds. The web section that was 0.15 mm thick was heated at 110° C. The web section that was 0.3 mm thick was controlled for the target temperature of 110° C. Conditions and results of the experiments are indicated in Table below.

| | | Example 3 | | | | |
|---|---|---|---|---|---|---|
| Temperature was initially adjusted by | | Hot gas | | | | |
| Temperature was secondly adjusted by | | Hot gas & pass rolls | | | | |
| Thickness of web W (mm) | | 0.15 | 0.3 | | | |
| Temperature of hot gas (° C.) | | 120 | 120 | | | |
| Temperature of pass rolls (° C.) | Pass roll 262A | None | 120 | 110 | 100 | 100 |
| | Pass roll 262B | None | 120 | 110 | 110 | 110 |
| | Pass roll 262C | None | 120 | 120 | 120 | 110 |
| Time after change in thickness (min.) | | 0 | 5 | 10 | 20 | 30 |
| Temperature of web at exit (° C.) | | 110 | 110 | 110 | 110 | 110 |
| Quality of photosensitivity | | Good | Good | Good | Good | Good |
| Time for heating of 0.3 mm-thick web W to target temperature (min.) | | 5 | | | | |

| | | Example 4 | | | | |
|---|---|---|---|---|---|---|
| Temperature was initially adjusted by | | Hot gas | | | | |
| Temperature was secondly adjusted by | | Hot gas | | | | |
| Thickness of web W (mm) | | 0.15 | 0.3 | | | |
| Temperature of hot gas (° C.) | | 120 | 140 | | | |
| Temperature of pass rolls (° C.) | Pass roll 262A | None | None | | | |
| | Pass roll 262B | | | | | |
| | Pass roll 262C | | | | | |
| Time after change in thickness (min.) | | 0 | 5 | 10 | 20 | 30 |
| Temperature of web at exit (° C.) | | 110 | 90 | 100 | 105 | 110 |
| Quality of photosensitivity | | Good | Poor | Poor | Poor | Good |
| Time for heating of 0.3 mm-thick web W to target temperature (min.) | | 30 | | | | |

In Example 3 with the drying apparatus 248, the hot gas was kept at 120° C. without a change. The thermal pass rolls 262A-262C were controlled and set commonly at 120° C. As a result, time of five (5) minutes was taken for the reach of the aluminum web W up to 110° C. upon a change of its thickness to 0.3 mm. Note that, after the reach of the web W to 110° C., the thermal pass rolls 262A-262C were gradually cooled and set commonly at 110° C.

In Example 4 of the prior art in which the temperature of the pass rolls was not controllable, the temperature of the hot gas was controlled and changed from 120° C. to 140° C. Time of 30 minutes was taken for the reach of the aluminum web W up to 110° C. upon a change of its thickness to 0.3 mm.

It is concluded according to Examples 3 and 4 that time for the heat adjustment of the aluminum web W was considerably reduced in comparison with the drier of the prior art. The speed of processing was highly raised.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A drying apparatus for drying web, comprising:

at least one thermal roll for transporting and heating said web, said thermal roll including a roll surface, having a static friction coefficient μ defined by contact with said web, wherein said static friction coefficient μ satisfies a condition of:

$$t+V \leqq G$$

wherein $$G = \mu \cdot \sigma_{A1} = \mu \cdot t \cdot \sin(\theta/2)$$

where t is tension applied to said web;

G is roll retaining force caused by friction with which said thermal roll retains said web;

V is thermal expansion force generated by thermal expansion of said web retained on said thermal roll;

$\sigma_{A1}$ is pressing force caused by said tension to said web and applied to said roll surface by said web;

θ is a wrap angle at which said web contacts said thermal roll.

2. A drying apparatus as defined in claim 1, wherein said thermal roll supports a back surface of said web;

further comprising at least one hot gas nozzle device, opposed to one surface of said web, for flow of hot gas thereto.

3. A drying apparatus as defined in claim 2, further comprising:

at least one drying box for containing said thermal roll and said hot gas nozzle device, said drying box being adapted to transporting said web inside;

an exhausting port, formed in a portion of said drying box positioned downwards as viewed in a feeding direction;

a fan or blower for flow of said hot gas from said hot gas nozzle device to said exhausting port along said web.

4. A drying apparatus as defined in claim 2, wherein said web has one surface reverse to said back surface, and coated with coating liquid.

5. A drying apparatus for drying coating liquid overlaid on one surface of web, comprising:

a heater for heating said web; and a temperature adjustor for controlling heat which said heater applies to said web according to a characteristic of said web.

6. A drying apparatus as defined in claim 5, wherein further comprising a signal generator for outputting changing information upon occurrence of a change in said characteristic, to supply said temperature adjustor therewith.

7. A drying apparatus as defined in claim 6, wherein said characteristic is at least one of a width, thickness, composition and substance of said web.

8. A drying apparatus as defined in claim 7, wherein said web includes at least first and second sections of web connected with each other by a splice portion.

9. A drying apparatus as defined in claim 8, wherein said signal generator includes a sensor for detecting said splice portion, and for outputting said changing information predetermined according to said second web section for being dried next upon detection of said splice portion.

10. A drying apparatus as defined in claim 8, further comprising at least one pass roll for transporting said web in contact with a back surface of said web;

said heater includes at least one thermal pass roll, disposed upstream or downstream from said pass roll, for contacting said back surface in transport of said web.

11. A drying apparatus as defined in claim 10, wherein said temperature adjustor includes a wrap angle adjustor for shifting said thermal pass roll relative to said web, to change a wrap angle where said thermal pass roll contacts said web.

12. A drying apparatus as defined in claim 10, wherein said temperature adjustor includes a heat exchange medium circulator, for circulating heat exchange medium at a predetermined temperature through a roll conduit inside said thermal pass roll.

13. A drying apparatus as defined in claim 12, wherein said thermal pass roll dries said first web at target temperature T1, and dries said second web at target temperature T2, and said temperature adjustor controls supply of said heat exchange medium upon changeover from said first web to said second web according to said target temperature T1 and T2;

if said target temperature T1<T2, said temperature adjustor operates in steps of supplying said thermal pass roll with heat exchange medium at temperature T3 higher than said target temperature T2, to raise temperature of said thermal pass roll quickly, and upon a reach of said temperature of said thermal pass roll to said target temperature T2, supplying said thermal pass roll with heat exchange medium at said target temperature T2; and if said target temperature T1>T2, said temperature adjustor operates in steps of supplying said thermal pass roll with heat exchange medium at temperature T4 lower than said target temperature T2, to lower temperature of said thermal pass roll quickly, and upon a reach of said temperature of said thermal pass roll to said target temperature T2, supplying said thermal pass roll with said heat exchange medium at said target temperature T2.

14. A drying apparatus as defined in claim 13, wherein said heat exchange medium comprises first heat exchange medium for being set selectively at said target temperature T1 or T2, and second heat exchange medium for being set selectively at said temperature T3 or T4.

15. A drying apparatus as defined in claim 5, wherein said heat exchange medium circulator includes first and second conduits for circulating respectively said first and second heat exchange media, and each of said first and second conduits is associated with a heat source for setting said first or second heat exchange medium at predetermined temperature, a tank for containing said first or second heat exchange medium, and a valve for openably closing said first or second conduit.

16. A drying apparatus as defined in claim 15, further comprising a temperature sensor for detecting roll surface temperature of said thermal pass roll, said roll surface temperature being adapted to control of said heat source according thereto.

17. A drying apparatus as defined in claim 13, wherein said heat exchange medium comprises first heat exchange medium of said target temperature T1, second heat exchange medium of said target temperature T2, and third heat exchange medium for being set selectively at said temperature T3 or T4.

18. A drying apparatus as defined in claim 17, wherein said heat exchange medium circulator includes first, second and third conduits for circulating respectively said first, second and third heat exchange media, and each of said first, second and third conduits is associated with a heat source for setting said first, second or third heat exchange medium at predetermined temperature, a tank for containing said first, second or third heat exchange medium, and a valve for openably closing said first, second or third conduit.

19. A drying apparatus as defined in claim 18, further comprising a temperature sensor for detecting roll surface temperature of said thermal pass roll, said roll surface temperature being adapted to control of said heat source according thereto.

20. A drying apparatus as defined in claim 8, wherein said at least one thermal pass roll comprises plural thermal pass rolls different in an amount of said heat from one another;

said temperature adjustor includes a selection mechanism for designating a selected one of said plural thermal pass rolls according to said characteristic, and for positioning said selected thermal pass roll in contact with a back surface of said web in transport of said web.

21. A drying apparatus for drying coating liquid overlaid on one surface of web, comprising:

at least one thermal pass roll for contacting a back surface of said web and for heating said web in transport thereof, and having a surface modified layer which is resistant to abrasion, and has a friction coefficient of 0.4 or less in relation to contact with said web.

22. A drying apparatus as defined in claim 21, wherein said at least one thermal pass roll is controllable for temperature.

23. A drying apparatus as defined in claim 22, wherein said surface modified layer comprises a diamond-like carbon layer.

24. A drying apparatus as defined in claim 22, further comprising a drying box for containing said at least one thermal pass roll, said web being passed inside said drying box.

25. A drying apparatus as defined in claim 24, further comprising a heat exchange medium circulator for circulating heat exchange medium at a predetermined temperature through a roll conduit inside said thermal pass roll, to control a roll surface temperature of said thermal pass roll.

26. A drying apparatus as defined in claim 25, further comprising:

a thermometer unit for measuring temperature of said web;

a controller for adjusting circulation of said heat exchange medium circulator according to said temperature being measured, to control said roll surface temperature of said thermal pass roll.

27. A drying apparatus as defined in claim 24, wherein said at least one thermal pass roll comprises plural thermal pass rolls controllable for temperature in an individual manner from one another.

* * * * *